US012161181B2

(12) United States Patent
Whitesell et al.

(10) Patent No.: US 12,161,181 B2
(45) Date of Patent: Dec. 10, 2024

(54) HINGEPLATE MECHANISM

(71) Applicant: BELL SPORTS, INC., Scotts Valley, CA (US)

(72) Inventors: Scott S. Whitesell, Camarillo, CA (US); Lawrence Broers, Aptos, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

(21) Appl. No.: 18/141,693

(22) Filed: May 1, 2023

(65) Prior Publication Data

US 2023/0329385 A1 Oct. 19, 2023

Related U.S. Application Data

(63) Continuation of application No. 17/243,719, filed on Apr. 29, 2021, now Pat. No. 11,678,710.

(51) Int. Cl.
*A42B 3/22* (2006.01)

(52) U.S. Cl.
CPC ..... *A42B 3/222* (2013.01); *A42B 3/223* (2013.01)

(58) Field of Classification Search
CPC ..... A42B 3/222; A42B 3/223
See application file for complete search history.

(56) References Cited

U.S. PATENT DOCUMENTS

2006/0117467 A1* 6/2006 Choi ..... A42B 3/222 2/424

FOREIGN PATENT DOCUMENTS

| | | | |
|---|---|---|---|
| EP | 1166666 | A1 | 1/2002 |
| EP | 1293139 | A1 | 3/2003 |
| EP | 1856999 | A2 | 11/2007 |

OTHER PUBLICATIONS

Extended European Search Report and Written Opinion for related European Patent Application No. 22171029.6, dated Aug. 31, 2022.

* cited by examiner

*Primary Examiner* — Khoa D Huynh
*Assistant Examiner* — Erick I Lopez
(74) *Attorney, Agent, or Firm* — Reed Smith LLP; Walter M. Egbert, III; Richard J. Brown

(57) ABSTRACT

A closed face motorcycle helmet includes a shell with an eyeport and a shield attached for hinged or pivoted motion between a closed or lowered position covering and sealing the eyeport and an open position or raised position displaced above the eyeport. A hinge plate is attached to the shell on each side and includes a moving pivot socket into which a hub of the shield is rotatably disposed for hinged movement and rearward movement of the shield between the raised and lowered positions.

21 Claims, 28 Drawing Sheets

HINGEPLATE MECHANISM

CROSS-REFERENCE TO RELATED APPLICATIONS

This application is a continuation of U.S. application Ser. No. 17/243,719, filed Apr. 29, 2021 entitled, "HINGEPLATE MECHANISM," of which the entirety of the disclosure of same is incorporated herein by reference.

TECHNICAL FIELD

This invention relates generally to helmets and more particularly to closed face motorcycle helmets with articulating and detachable face shields.

BACKGROUND

Many people wear protective safety helmets while enjoying outdoor riding activities such as snowmobiling, motorcycle riding, and bicycling. While such helmets vary widely in design and features, many include an articulating shield that protects the eyes and/or face of the helmet wearer. Open face helmets have a hard shell that surrounds and covers the brow, crown and sides of the user's head, leaving the face open. A closed face motorcycle helmet has a hard shell that surrounds and covers a rider's head from the neck up and an eyeport through which the rider can see. Motorcyclists often choose a helmet design known as a "closed face" motorcycle helmet. A clear shield is hingedly attached to the sides of the helmet and can be flipped down to cover the eyeport for normal use or flipped up out of the way when desired. The shield is typically formed of Plexiglas® or other clear plastic, which may be colorless or tinted. When the shield is covering the eyeport, a peripheral seal around the eyeport seals against the inside surface of the shield to prevent ingress of air, water, and debris into the interior of the helmet.

Whether the helmet is an open face or closed faced design, in some instances, it is desirable to move the shield toward the front of the helmet shell when it is lowered into a protective position so that the top edge of the shield contacts the edge of the shell to improve aerodynamics and/or eliminate air flow between the shield and the helmet shell. Conventional helmets comprise hingeplates on each side of the helmet to raise and lower the shield Conventional hingeplates comprise a baseplate fixed to the helmet incorporating a pivot post on which a movable plate pivots, which is in turn connected to the shield to raise or lower the shield.

Under certain environmental conditions, the inner surface of the shield when closed and sealed is susceptible to condensation formation or "fogging," which can interfere with a rider's vision and thus must be eliminated. Helmet designers have used several methods to eliminate shield condensation. Such methods include, for example, coating the inside surface of the shield with a hydrophobic coating or designing a helmet vent system that directs outside air into the helmet and across the interior surface of the shield. However, hydrophobic coatings are somewhat but not completely successful and a shield vent system works only when the rider is moving. Another very effective method of clearing a shield fogged with condensation is simply to open the shield to allow outside air into the helmet. However, opening the shield too far while moving can allow high velocity air to hit the riders face and eyes, which is uncomfortable and dangerous. It thus is imperative when employing this method that the shield be opened or cracked by a small amount that is just enough to break contact between the shield and the peripheral seal around the eyeport. Cracking the shield slightly in this way admits a sufficient stream of outside air to clear condensation but does not allow an excessive airflow that might interfere with the rider's comfort or vision.

Most helmets incorporate shield set positions or "detents" through which the shield passes as it is moved from its closed position to its open position. In most cases, however, the first detent or first open position is too large for use in clearing a fogged shield because it allows high velocity air to hit the rider's face and eyes. Some more recent close faced helmets incorporate a mechanism for cracking the shield slightly when desired. The helmet manufacturer Arai, for example, incorporates a small sliding tab on the lower left edge of the helmet shield that, when slid forward, engages a feature on the periphery of the eyeport to cause the shield to rotate slightly upwardly from its closed position. While the Arai and similar systems represent steps in the right direction, they nevertheless tend to have inherent shortcomings. They can, for instance, be difficult to operate, particularly when a rider is wearing gloves.

Another problem encountered by motorcyclists wearing closed face helmets is that the shield of the helmet can accidentally fly open under certain circumstances. For instance, a rider may occasionally rotate his head to view objects outside of his peripheral vision. Similarly, an individual engaging in a high speed race may turn his head to check for other riders to his side or rear. At high speeds, these and similar motions may cause the shield to lift and fly open due to extreme and unbalanced aerodynamic forces.

Thus, there is a need for a closed face helmet with a highly reliable and effective mechanism for cracking the shield of the helmet slightly when desired to remove a condensation fog from the inside surface of the shield. There is a further need for a rider to be able to restrain the shield of the helmet so that it does not accidentally fly open at high speeds when the rider turns or raises his head. These needs should be met without interfering with the normal opening and closing operation of the helmet shield. In addition, the mechanism providing the needed functions should be easily operated even while wearing gloves, should be fail safe to prevent jamming, and should be automatically recoverable in the event of improper or unintended operation by a rider. It is to the provision of a helmet with precision shield control that satisfies all of these needs and more that the disclosed subject matter is primarily directed.

SUMMARY OF THE DISCLOSED SUBJECT MATTER

In one aspect, this disclosure provides a pivot mechanism for a shield for a helmet, in which the pivot mechanism is configured to allow for the shield to be rotated about a pivot point between a raised position and a lowered position and moved rearward when moved to the lowered position. In this aspect, the pivot mechanism provides for two-fold translation of the shield comprising a rotational translation and a rearward translation.

Provided is a hinge mechanism for a shield for a helmet comprising:

- a base plate configured to be attached to an outer shell of the helmet, and
- a pivot member engaged to the base plate, configured to be engaged to a pivot post of the shield; wherein the shield is configured to rotate about the pivot point between a raised position and a lowered position and wherein the pivot member is configured to move a pivot point of the shield rearward in the helmet when the shield is lowered.

Embodiments of the hinge mechanism include the following, alone or in any combination.

The hinge mechanism comprising a base plate configured to be attached to an outer shell of the helmet, the base plate comprising a planar region having a first surface, a second surface, a first end, a second end, a first side and a second side; a raised portion proximate the first end defining a curved face, a raised portion proximate the first side; a raised portion proximate the second side; wherein a portion of the raised portion proximate the first side and a portion of the raised portion proximate the second side are disposed parallel to each other and define slide tracks;

(b) a pivot member comprising a planar region having a first surface, a second surface, a first end, a second end, a first side and a second side, configured to be engaged to a pivot post of the shield; wherein the first side and a second side each have a slide rail configured to slidingly engage the slide tracks proximate the respective first and second sides of the base plate; and the first side and the second side each have extensions that extend beyond the second end defining a space therebetween;

(c) a curved detent member having a first end, a second end, and a raised portion comprising a convex face comprising a first detent position proximate to the first end, a second detent position proximate to the second end, a first slide extension on the first end configured to slidingly engage the extension of the first side of the pivot member, and a second slide extension on the second end configured to slidingly engage the extension of the second side of the pivot member;

(d) a first resilient member engaged to the base plate and the second end of the pivot member, configured to urge the pivot member toward the first end of the base plate; and (e) a second resilient member engaged to the second end of the pivot member and the detent member, configured to urge the detent member away from the second end of the pivot member.

The hinge mechanism wherein the first resilient member comprises a spring.

The hinge mechanism wherein the second resilient member comprises a spring.

The hinge mechanism comprising a base plate configured to be attached to an outer shell of the helmet, the base plate comprising a planar region having a first surface, a second surface, a first end, a second end, a first side and a second side; a raised portion proximate the first end defining a curved face, a raised portion proximate the first side; a raised portion proximate the second side; wherein a portion of the raised portion proximate the first side and a portion of the raised portion proximate the second side are disposed parallel to each other and each comprise a face perpendicular to the generally planar region and a flange disposed parallel to and spaced above the first surface of the generally planar region, wherein said portions define slide tracks;

(b) a pivot member comprising a planar region having a first surface, a second surface, a first convex end, a second convex end, a first side and a second side; wherein the first surface of the pivot member and the first surface of the base plate face each other; the first convex end has a curve generally complementary to the curved face of the of the raised portion proximate the first end of the base plate;

the first side and a second side each have a slide rail configured to slidingly engage the slide tracks proximate the respective first and second sides of the base plate;

the first side and the second side each have extensions that extend beyond the second end defining a space therebetween and the extensions each have a rabbet in the first surface of the pivot member; and the second surface of the pivot member is configured to be engaged to a pivot post of the shield;

(c) a curved detent member having a first, end a second end, a concave face disposed between the first end and the second end and complementary to the convex second end of the pivot member, a convex face comprising a first detent position proximate to the first end, a second detent position proximate to the second end, and optionally one or more additional detent positions between the first detent position and the second detent position, a first slide extension on the first end configured to slidingly engage the rabbet of the extension of the first side of the pivot member, and a second slide extension on the second end configured to slidingly engage the rabbet of the extension of the second side of the pivot member;

(d) a first resilient member engaged to the base plate proximate to the first side and the second end and engaged to the pivot member at the end of the slide rail proximate to the first side and the second end of the pivot member, configured to urge the pivot member toward the first end of the base plate; and (e) a second resilient member engaged to the second end of the pivot member and the concave face of the detent member, configured to urge the detent member away from the second end of the pivot member.

The hinge mechanism further configured with a detent to dispose the shield in a vented position.

In another aspect, this disclosure provides a pivot mechanism for a shield for a helmet, in which the pivot mechanism is configured to allow for the shield to be rotated about a pivot point between a raised position and a lowered position, moved rearward and drawn inward toward the helmet when moved to the lowered position. In this aspect, the pivot mechanism provide for three-fold translation of the shield comprising a rotational translation, a rearward translation and an inward translation.

Provided is a hinge mechanism for a shield for a helmet comprising a base plate configured to be attached to an outer shell of the helmet, and a pivot member engaged to the base plate, configured to be engaged to a pivot post of the shield; wherein the shield is configured to rotate about the pivot point between a raised position and a lowered position and wherein the pivot member is configured to move a pivot point of the shield rearward in the helmet when the shield is lowered; and the hinge mechanism is further configured to draw the shield inward toward the helmet when the shield is moved to the lowered position.

Embodiments of the hinge mechanism include the following, alone or in any combination.

The hinge mechanism comprising a base plate configured to be attached to an outer shell of the helmet, the base plate comprising a planar region having a first surface, a second surface, a first end, a second end, a first side and a second side; a raised portion proximate the first end defining a curved face, a raised portion proximate the first side; a raised portion proximate the second side; wherein a portion of the raised portion proximate the first side and a portion of the raised portion proximate the second side are disposed parallel to each other and define tracks having a stepped configuration;

(b) a pivot member comprising a planar region having a first surface, a second surface, a first end, a second end, a first side and a second side, configured to be engaged to a pivot post of the shield; wherein the first side and a second side each have a stepped rail configured to engage the tracks proximate the respective first and second sides of the base plate; and the first side and the second side each have extensions that extend beyond the second end defining a space therebetween;

(c) a curved detent member having a first end, a second end, and a raised portion comprising a convex face comprising a first detent position proximate to the first end, a second detent position proximate to the second end, a first slide extension on the first end configured to slidingly engage the extension of the first side of the pivot member, and a second slide extension on the second end configured to slidingly engage the extension of the second side of the pivot member;

(d) a first resilient member engaged to the base plate and the second end of the pivot member, configured to urge the pivot member toward the first end of the base plate; and (e) a second resilient member engaged to the second end of the pivot member and the detent member, configured to urge the detent member away from the second end of the pivot member.

The hinge mechanism wherein the first resilient member comprises a spring.

The hinge mechanism wherein the second resilient member comprises a spring.

The hinge mechanism further configured with a detent to dispose the shield in a vented position.

The hinge mechanism comprising a base plate configured to be attached to an outer shell of the helmet, the base plate comprising a planar region having a first surface, a second surface, a first end, a second end, a first side and a second side; a raised portion proximate the first end defining a curved face, a raised portion proximate the first side; a raised portion proximate the second side; wherein a portion of the raised portion proximate the first side and a portion of the raised portion proximate the second side are disposed parallel to each other and each comprise a face perpendicular to the generally planar region and a flange disposed parallel to and spaced above the first surface of the generally planar region, wherein said portions define slide tracks;

(b) a pivot member comprising a planar region having a first surface, a second surface, a first convex end, a second convex end, a first side and a second side; wherein the first surface of the pivot member and the first surface of the base plate face each other; the first convex end has a curve generally complementary to the curved face of the of the raised portion proximate the first end of the base plate;

the first side and a second side each have a slide rail configured to slidingly engage the slide tracks proximate the respective first and second sides of the base plate;

the first side and the second side each have extensions that extend beyond the second end defining a space therebetween and the extensions each have a rabbet in the first surface of the pivot member; and the second surface of the pivot member is configured to be engaged to a pivot post of the shield;

(c) a curved detent member having a first, end a second end, a concave face disposed between the first end and the second end and complementary to the convex second end of the pivot member, a convex face comprising a first detent position proximate to the first end, a second detent position proximate to the second end, and optionally one or more additional detent positions between the first detent position and the second detent position, a first slide extension on the first end configured to slidingly engage the rabbet of the extension of the first side of the pivot member, and a second slide extension on the second end configured to slidingly engage the rabbet of the extension of the second side of the pivot member;

(d) a first resilient member engaged to the base plate proximate to the first side and the second end and engaged to the pivot member at the end of the slide rail proximate to the first side and the second end of the pivot member, configured to urge the pivot member toward the first end of the base plate; and (e) a second resilient member engaged to the second end of the pivot member and the concave face of the detent member, configured to urge the detent member away from the second end of the pivot member.

In another aspect, disclosed is a helmet comprising a hinge mechanism described above, including any of the embodiments described above or elsewhere herein, alone or in any combination.

Embodiments of the helmet include the helmet further comprising a shield engaged to the hinge mechanism.

DETAILED DESCRIPTION

Figure 1:
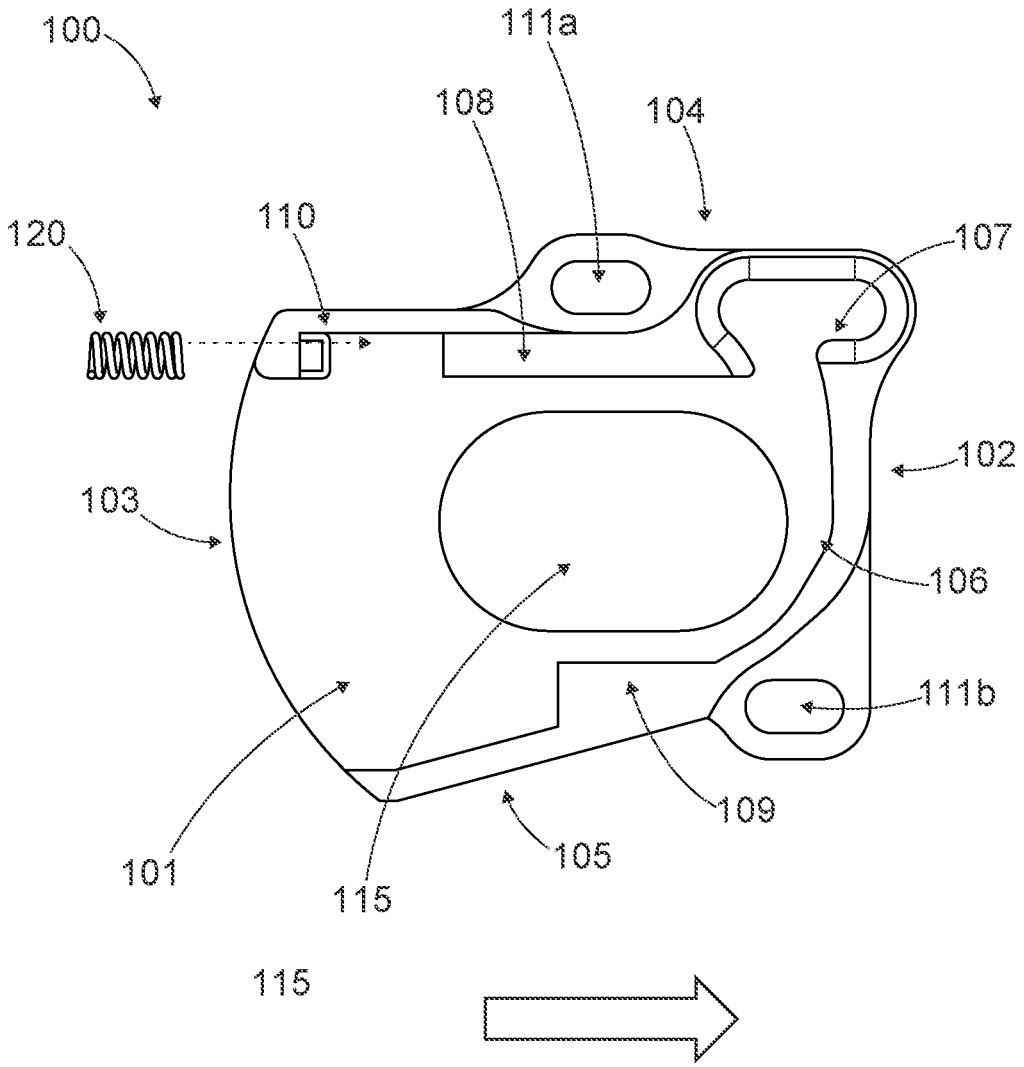
FIG. 1 shows an elevation view of a base plate of a pivot mechanism according to an exemplary embodiment of the disclosed subject matter.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

Unless otherwise explicitly indicated, as used herein the terms "internal", "inner" and "inside" indicate a relative position towards the helmet portion which is or would be closer to the wearer's head. Unless otherwise explicitly indicated, as used herein the terms "exterior", "outer" and "external" indicate a relative position towards the helmet portion which is or would be closer to the outside of a helmet which is or would be away from the wearer's head. Similarly, terms such as "inward", "front", "forward", "rear", "rearward", "side", "right", "left", "bottom", "lower", "top", "upper", "raised", "brow", "crown", and the like refer to portions of a helmet or mechanisms therein relative to the helmet as worn by a user of the helmet.

The terms "pivot mechanism", "hinge mechanism" and "hingeplate" are used interchangeably herein to refer to a device that is configured to engage an end of a shield for a helmet and provide a locus for the shield to be articulated so that it can be raised or lowered.

A helmet as described herein can be used for a cyclist, football player, hockey player, baseball player, lacrosse player, polo player, climber, auto racer, motorcycle rider, motocross racer, skier, snowboarder or other snow or water athlete, sky diver or any other athlete in a sport. Other industries also use protective headwear, such that individuals employed in other industries and work such as construction workers, soldiers, fire fighters, pilots, or types of work and activities can also use or be in need of a safety helmet, where similar technologies and methods can also be applied. Each of the above listed sports, occupations, or activities can use a protective helmet that comprises an outer shell and an inner energy-absorbing or energy management material and a shield for shielding the wearer's eyes or face. For convenience, protective helmets can be generally classified as either in-molded helmets or hard shell helmets. In-molded helmets can comprise one layer, or more than one layer, including a thin outer shell, an energy-absorbing layer or impact liner, and a comfort liner or fit liner. Hard-shell helmets can comprise a hard outer shell, an impact liner, and a comfort liner. The hard outer shell can be formed by injection molding and can include Acrylonitrile-Butadiene-Styrene (ABS) plastics or other similar or suitable material. The outer shell for hard-shell helmets is typically made hard enough to resist impacts and punctures, and to meet the related safety testing standards, while being flexible enough to deform slightly during impacts to absorb energy through deformation, thereby contributing to energy management. Hard-shell helmets can be used as skate bucket helmets, motorcycle helmets, snow and water sports helmets, football helmets, batting helmets, catcher's helmets, hockey helmets, and can be used for BMX riding and racing. While various aspects and implementations presented in the disclosure focus on embodiments comprising hard-shell helmets or helmets comprising an outer shell and a shield, the disclosure also relates and applies to other helmets, applications, and embodiments in which the principles and features discussed herein can be advantageously applied. As such, a helmet comprising a pivot mechanism as disclosed herein can be employed wherever a conventional helmet is used to take advantage of the additional benefits described herein.

This disclosure provides a pivot or hinge mechanism for a helmet or protective head gear that includes an outer shell and a protective shield such as a face shield or an eye shield, wherein the pivot mechanism provides for pivoting the shield between a raised (open) position and a lowered (closed) position. The pivot mechanism also provides for moving the shield rearward relative to the helmet when the shield is rotated to the lowered position. The pivot mechanism may also provide for moving the end of the shield inward relative to the helmet when the shield is rotated to the lowered position.

One of skill in the art can appreciate that helmets have a high degree of bilateral symmetry wherein the sides of the helmet are substantially mirror images of each other. Shields on helmets typically protect the wearer's face and wrap around both sides of the helmet to pivot points or fulcrums about which the shield articulates between raised and lowered positions. One can also appreciate that a helmet may comprises a pair of pivot or hinge mechanisms described herein, one on each side of the helmet in which each of the pivot mechanisms engage an end of the shield, wherein the pivot mechanisms are substantially similar mirror images of each other. A helmet may, but does not necessarily, comprise a pair of such pivot mechanisms with a shield therebetween. For simplicity of presentation, a single pivot mechanism is described and shown in the figures herein.

The following figures depict specific embodiments of the pivot mechanism. For ease of presentation, an open arrow in the Figures indicates the direction to the front of a helmet containing the pivot mechanism and/or shield. In the Figures, the pivot mechanism and parts thereof are depicted as viewed from the outside of the helmet toward the right side of the helmet, unless specified otherwise.

FIG. 1 shows an elevation view of a base plate of a pivot mechanism according to an exemplary embodiment of the disclosed subject matter. The base plate 100 is configured to be attached to an outer shell of the helmet (not shown). In this view, the baseplate is viewed from the outside of the right side of the helmet. The base plate 100 comprises a planar region 101 having a first surface, a second surface, a first end 102, a second end 103, a first side 104 and a second side 105. The base plate 100 comprises a raised portion proximate the first end 102 defining a curved face 106, a raised portion 108 proximate the first side 104; a raised portion 109 proximate the second side 105; wherein a portion of the raised portion 108 proximate the first side 104 and a portion of the raised portion 109 proximate the second side 105 are disposed parallel to each other and define slide tracks. The raised portions 106 and 108 also define a detent well 107 at the upper front corner of the baseplate. A detent post 110 is disposed at the upper rear corner of the baseplate. Through-holes 111*a* and 111*b* provide loci where the base plate 100 can be fixed to the shell of the helmet, using screws, rivets or other fasteners (not shown). An elongate hole 115 is disposed in the planar region 101. Also shown in FIG. 1 is a first resilient member, coil spring 120, which can be engaged to the base plate at the detent post 110, as shown by the dashed arrow. The coil spring 120 is a non-limiting embodiment of the first resilient member. Other types of springs can be envisioned, such as v-springs or cantilever springs. As discussed further below, the spring 120 is configured to engage a pivot member 200 and urge it toward the first end 102 of the base plate 100.

Figure 2:
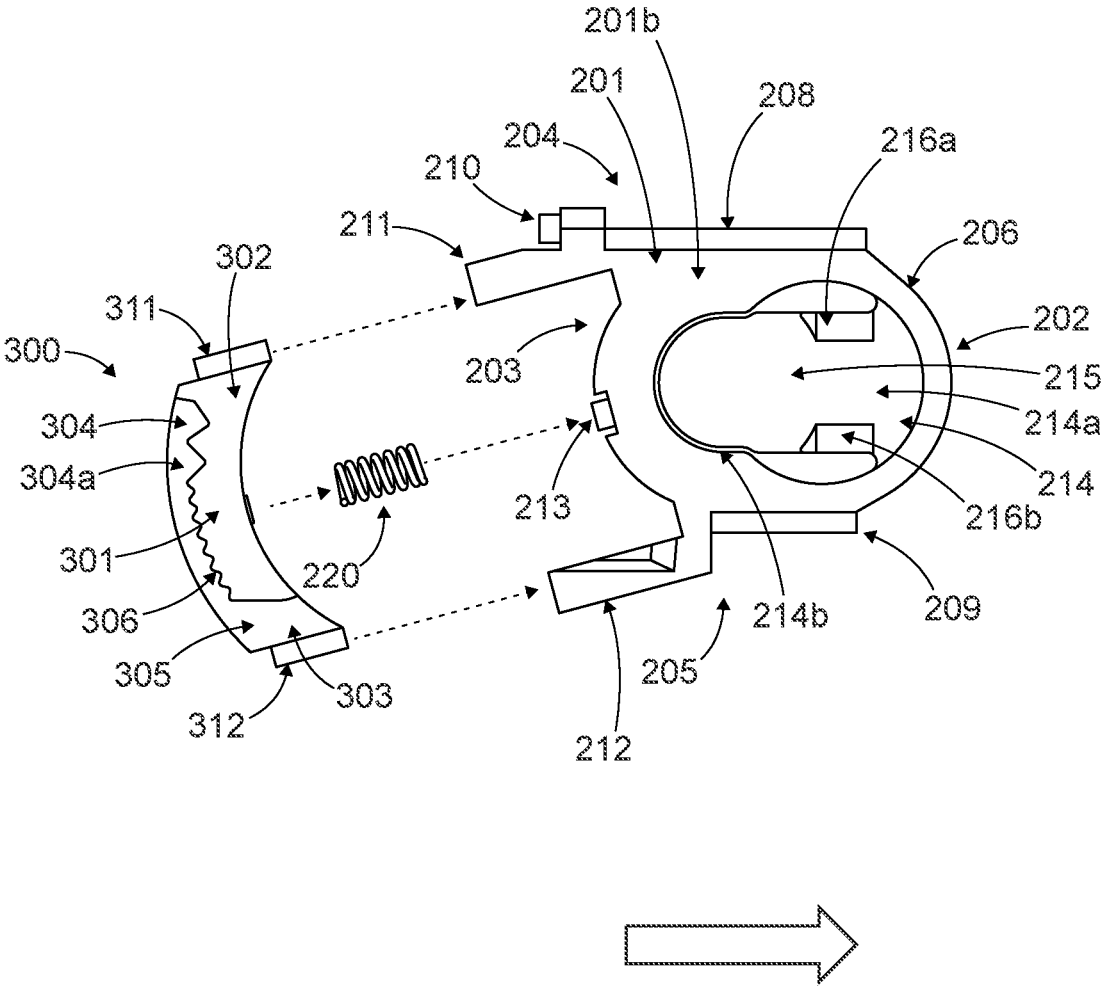
FIG. 2 shows an elevation view of a pivot member and a detent member of a pivot mechanism, according to an exemplary embodiment of the disclosed subject matter.

FIG. 2 shows an elevation exploded view of a pivot member 200 and a detent member 300 of the pivot mechanism, according to an exemplary embodiment of the disclosed subject matter.

The pivot member 200 comprises a main body 201 having a first surface 201*a*, a second surface 201*b*, a first end 202, a second end 203, a first side 204 and a second side 204, configured to be engaged to a pivot post of the shield. The first side 204 and a second side 205 each have a slide rail, 208 and 209 respectively, configured to slidingly engage the slide tracks 108 and 109 proximate the respective first side 104 and second side 105 of the base plate 100. The first side 204 and the second side 205 each have extensions, 211 and 212 respectively, that extend beyond the second end 205 defining a space therebetween. The pivot member 200 also comprises a detent post 210 proximate to the first side 204 that is configured to engage the first resilient member, spring 120. The pivot member 200 also comprises a detent post 213 proximate to the second end 203 that is configured to engage a first end of a second resilient member, coil spring 220. The coil spring 220 is a non-limiting embodiment of the second resilient member. Other types of springs can be envisioned, such as v-springs or cantilever springs.

The second surface 201*b* comprises a keyhole opening 214 having a wide dimension 214*a* proximate the first end 202 of main body 201 and a narrow dimension 214*b* proximate the second end 203 of main body 201. A panel 215 having flanges 216*a* and 216*b* can be seen through keyhole opening 214.

FIG. 2 also shows a curved detent member 300 having a first end 302, a second end 303, and a raised portion 301 comprising a convex face comprising a first detent position 304 proximate to the first end 302, a second detent position 305 proximate to the second end 303. In this embodiment, the detent member further comprises an additional detent position 304*a* adjacent to first detent position 304 and a region between the first detent position and the second detent position comprising plurality of small sawtooth detents 306. The detent member 300 also comprises a first slide extension or flange 311 on the first end 302 configured to slidingly engage the extension 211 of the first side 204 of the pivot member 200, and a second slide extension or flange 312 on the second end 303 configured to slidingly engage the extension 212 of the second side 205 of the pivot member 200.

Dashed arrows show how the detent member engages pivot member 200 with spring 220 disposed between them. As discussed further below, the second resilient member, spring 220, engaged to the second end of the pivot member 200 and the detent member 300 is configured to urge the detent member 300 away from the second end 203 of the pivot member 200.

Figure 3:
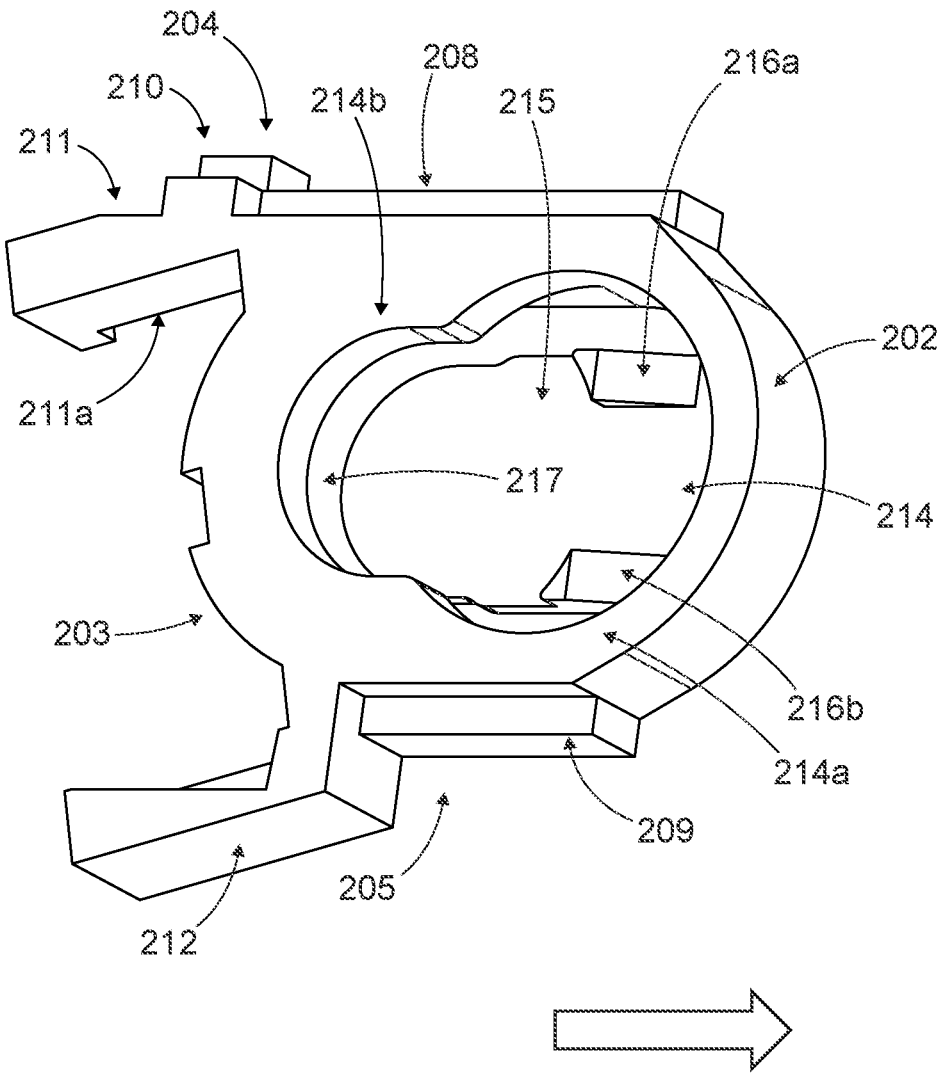
FIG. 3 shows a perspective view of the pivot member of FIG. 2, according to an exemplary embodiment of the disclosed subject matter.

FIG. 3 shows a perspective view of the pivot member 200 of FIG. 2. It shows that main body 201 of pivot member comprises a cavity or void 217 within the main body 201, defined by the first end 202, the second end 203, the first side 204 and the second side 205. A rabbet 211*a* on the projection 211 is also shown, and it is configured to be slidingly engaged by the flange 311 on detent member 300. A similar rabbet, not visible in this figure, is configured to be slidingly engaged by the flange 312 on detent member 300.

Figure 4:
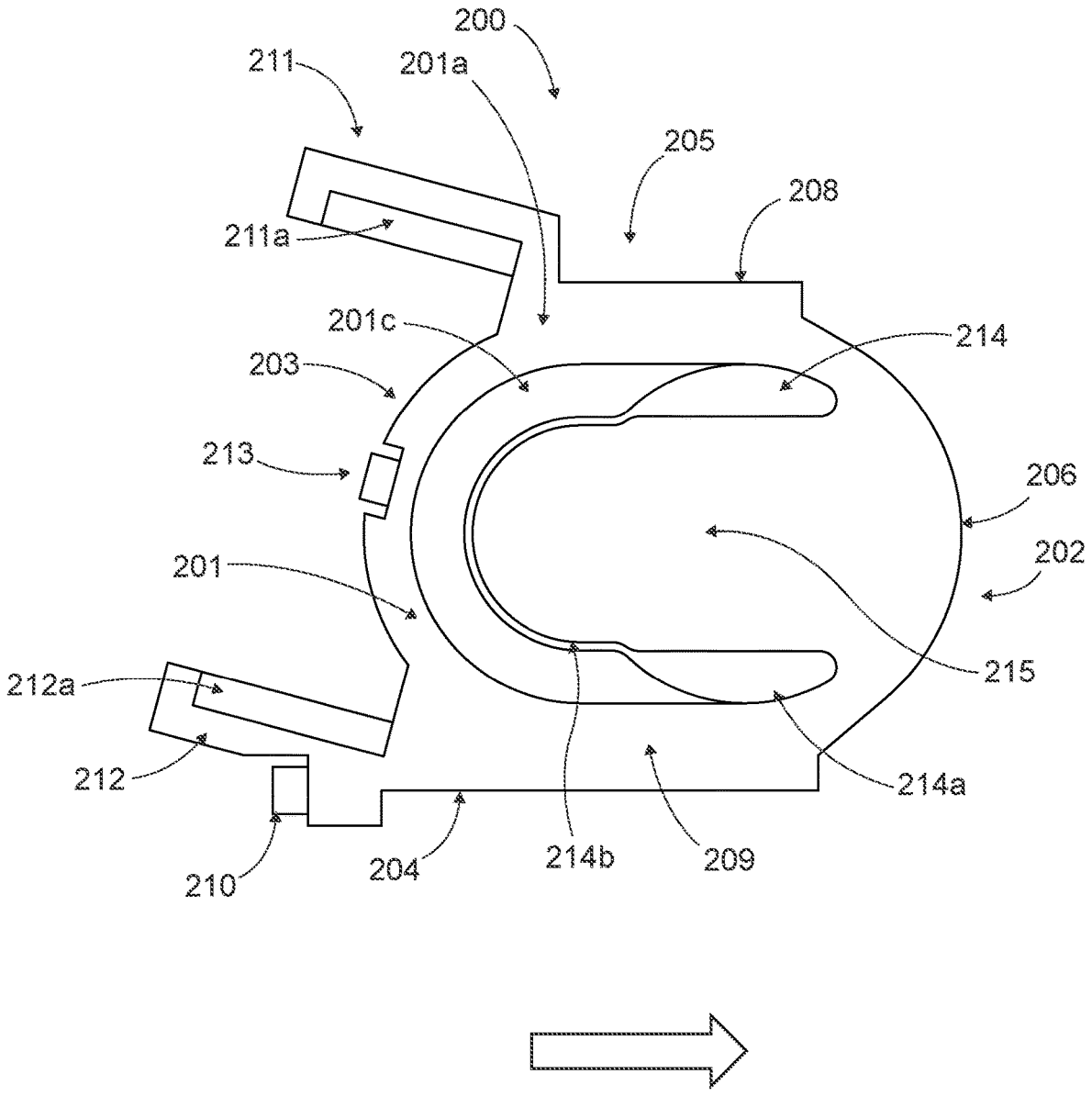
FIG. 4 shows a reverse elevation view of the pivot member of FIG. 2, according to an exemplary embodiment of the disclosed subject matter.

FIG. 4 shows a reverse elevation view of the pivot member 200 of FIG. 2. Rabbet 211*a* on the projection 211 is shown, configured to be slidingly engaged by the flange 311 on detent member 300. A similar rabbet, 212*a*, is configured to be slidingly engaged by the flange 312 on detent member 300. These rabbets are configured to be in parallel so that detent member 300 can move forward and backward relative to pivot member 200 along tracks defined by the rabbets.

The first surface 201*a* of the main body 201 comprises a panel 215 attached to the pivot member 200 proximate to the first end 202 at the panel 215's first end. A curved slot 201*c* in the first surface 201*a* separates the sides and the second (free) end of the panel 215 from the first surface. Seen behind panel 215 through slot 201*c* is opening 214 in the second surface 201 of pivot member 200. Panel 215 is sized so that the second (free) end can pass through hole 115 in base plate 100 when pushed inward by a projection of a shield inserted into opening 214, as discussed further below.

Figure 5:
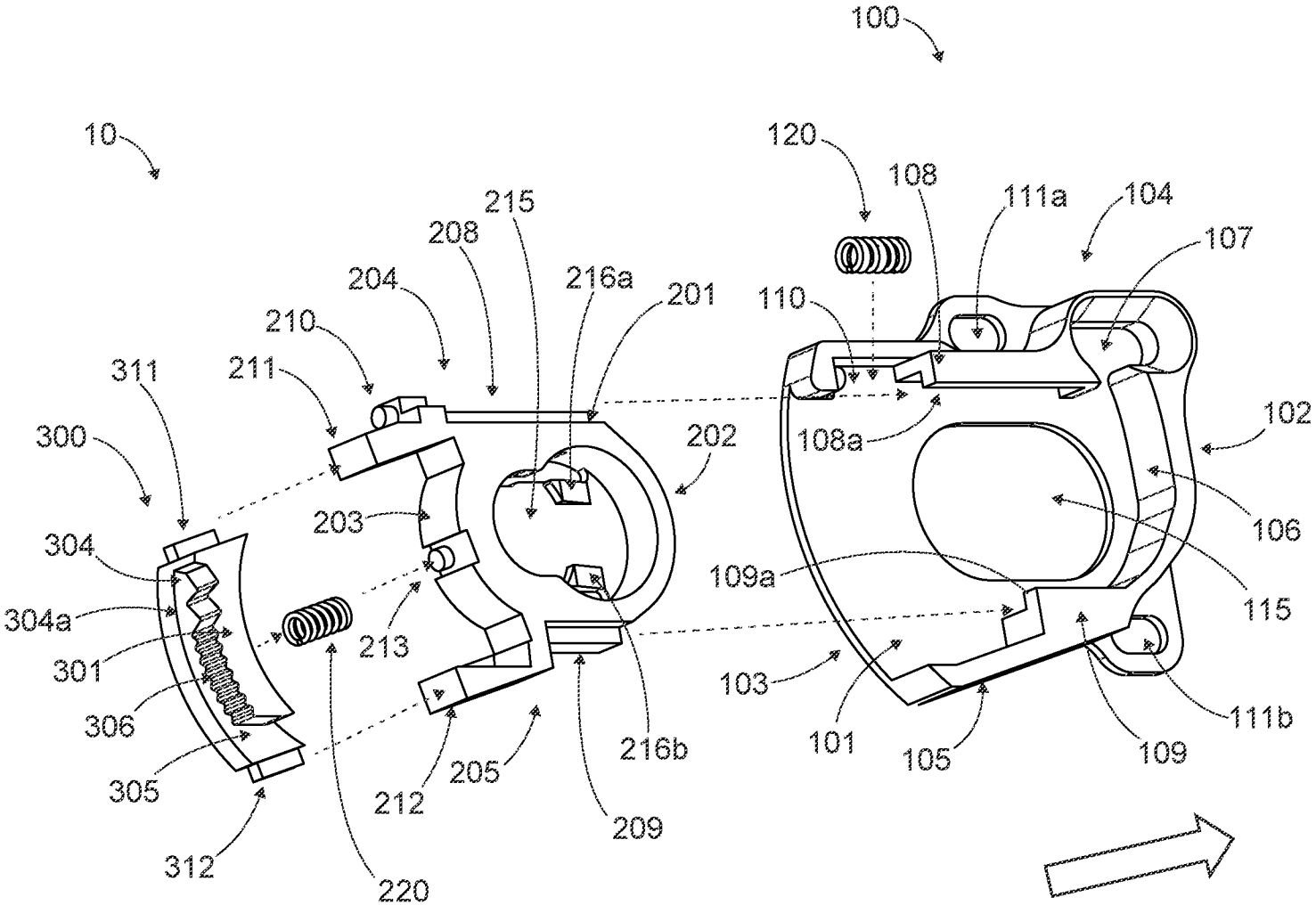
FIG. 5 shows an exploded perspective view of a pivot mechanism, according to an exemplary embodiment of the disclosed subject matter.

FIG. 5 shows an exploded perspective view of the pivot mechanism showing how the pivot member 200 is engaged to the base plate 100, as indicated by the dashed arrows. Base plate 100 comprises a portion of the raised portion 108 proximate the first side 104 and a portion of the raised portion 109 proximate the second side 105 disposed parallel to each other. Raised portion 108 and raised portion 109 each comprise a face perpendicular to the generally planar region 101 and a flange 108*a* and a flange 109*a*, respectively, wherein the flanges are disposed parallel to and spaced above the first surface of the generally planar region 101 to provide grooves or rabbets. Raised portions 108 and 109 define slide tracks that are engaged by the slide rails 208 and 209 of the pivot member 200.

Pivot member 200 comprises a main body 201 having a planar first surface 201*a* wherein the first surface 201*a* of the pivot member 200 and the first surface of the base plate planar region 101 face each other, and are slidingly engaged when the slide rails 208 and 209 are inserted into the grooves of raised portions 108 and 109 of base plate 100. When slidingly engaged, pivot member 200 can slide forward (toward first end 102 of base plate 100) or rearward (toward second end 103 of base plate 100) in relation to base plate 100.

Pivot member comprises a first convex end 202 that has a curve generally complementary to the curved face 106 of the raised portion proximate the first end 102 of the base plate 100. The second end 203 has a convex face that has a curve generally complementary to the concave face of detent member 300.

Figure 6:
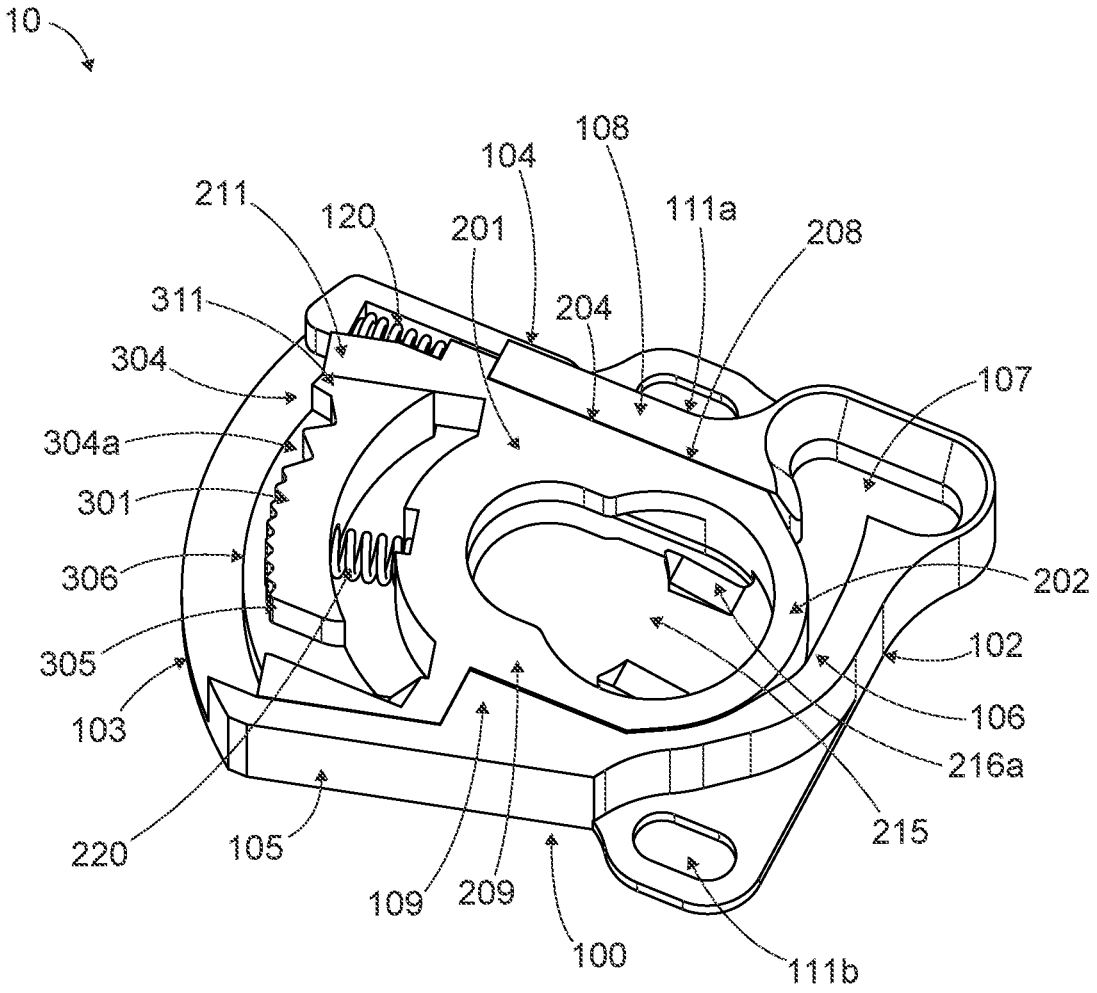
FIG. 6 shows a perspective view of pivot mechanism, according to an exemplary embodiment of the disclosed subject matter.

FIG. 6 shows a perspective view of the assembled pivot mechanism.

As described above, a shield comprises a curved portion that wraps around the front of a helmet and two ends that engage pivot mechanisms on each side of the helmet. In the following figures, for simplicity of presentation only one end 400 of a shield is shown. The shield end 400 is configured to engage the pivot mechanism disclosed herein. The other end of the shield would be a mirror image of the depicted shield end 400. The shield and its components generally comprise transparent plastic, which may be optionally tinted.

Figure 7:
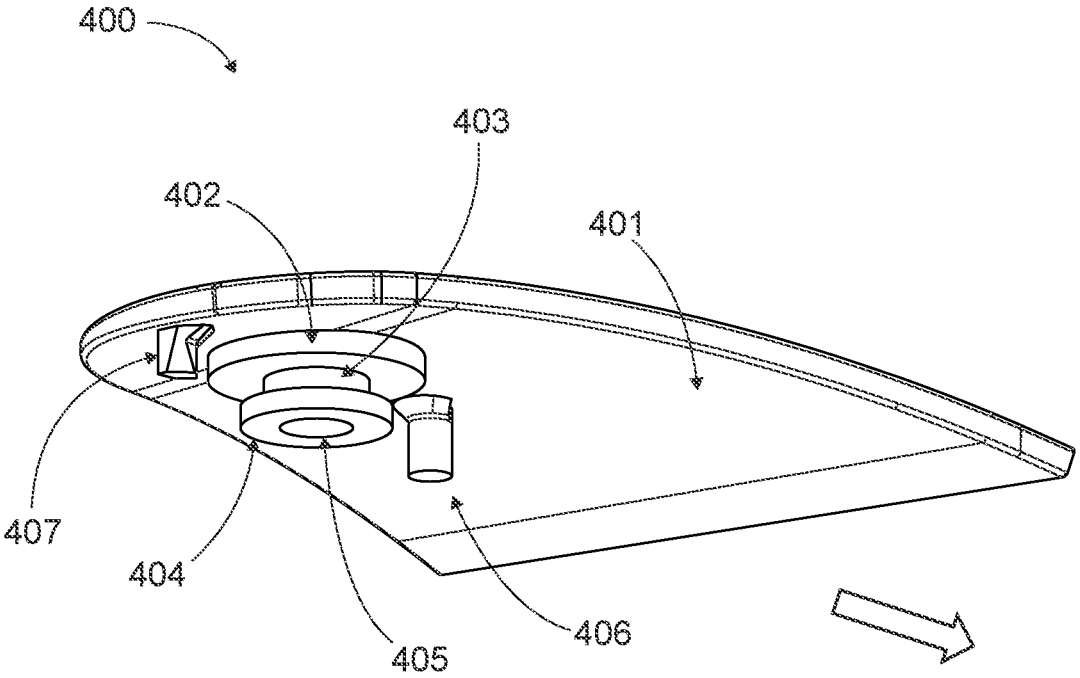
FIG. 7 shows a perspective view of a shield, according to an exemplary embodiment of the disclosed subject matter.

FIG. 7 shows a perspective view of shield end 400 viewed from the inside of a helmet, according to an exemplary embodiment. Shield end 400 comprises a generally flat region 401 that would extend into the curved region of a shield if shown. Shield end comprises a pivot portion comprising a well 402 extending from its outside face to the inside face shown. Pivot post 403 extends inward from well 402 to a flange 404 at the end of pivot post 403. A hole 405 is in communication with a passage through flange 404, post 403 and into well 402. A first detent post 406 is disposed on the inside face of shield end 400 forward of the pivot portion. A second detent post 407 is disposed on the inside face of shield end 400 rearward of the pivot portion.

Figure 8:
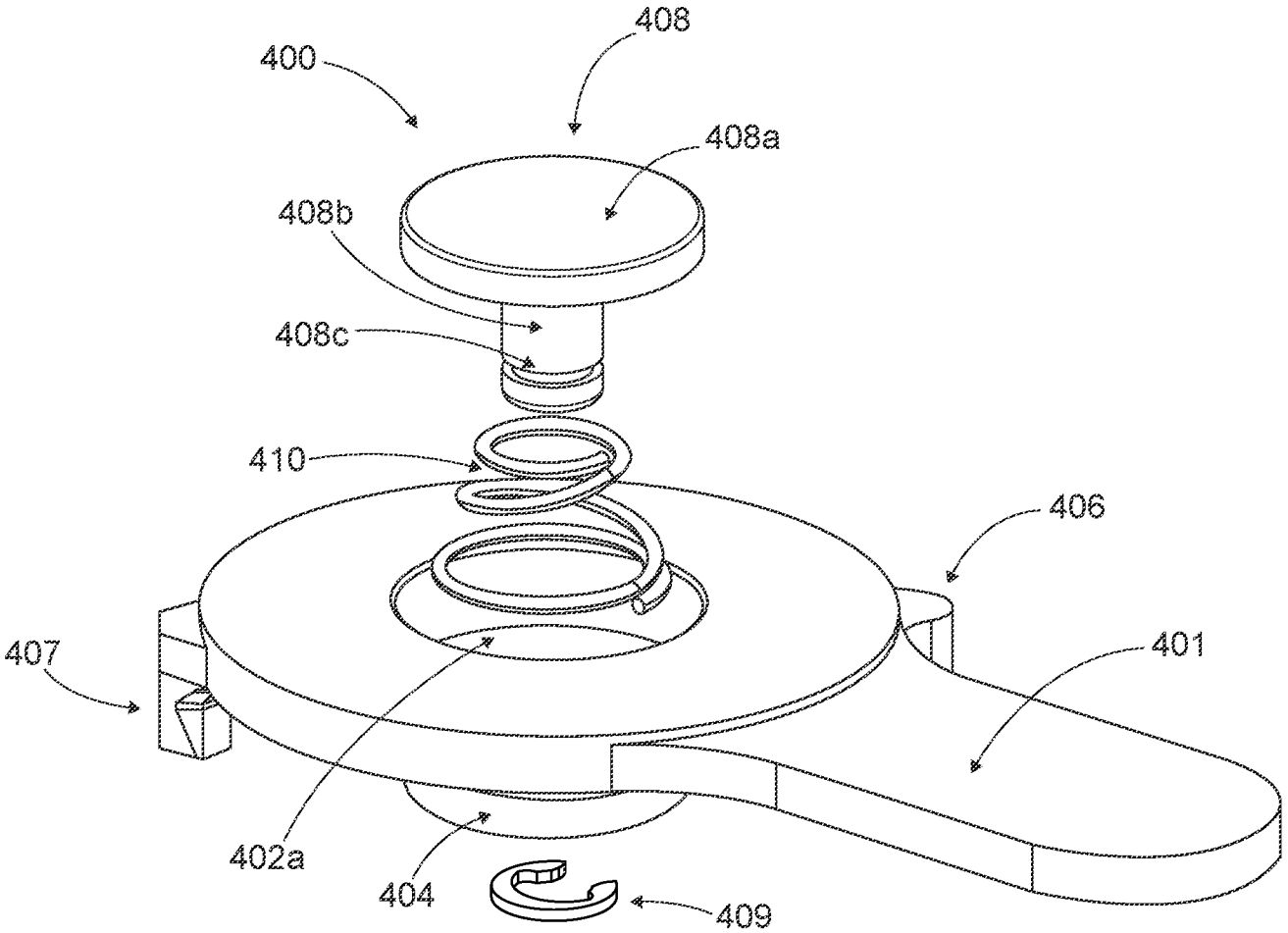
FIG. 8 shows a perspective exploded view of a shield assembly, according to an exemplary embodiment of the disclosed subject matter.

FIG. 8 shows a perspective exploded view of a shield assembly viewed from outside a helmet, according to an exemplary embodiment. In this figure, for ease of illustration, region 401 is depicted as a flat narrow blade attached to a circular region 401*a*. The opening of well 402 is shown at 402*a*. Flange 404 is shown behind circular region 401*a*. Detent posts 406 and 407 are shown at approximately diametrically opposed sides of circular region 401*a*. A release button 408 is configured to pass into opening 402*a* and into hole 405 shown in FIG. 7. Release button 408 comprises a broad flat region 408*a* sized to fit within the opening 402*a*. Button post 408*b* is sized to fit within hole 405. An annular groove 408*c* can engage a locking ring 409 inserted into hole 405 so that button 408 is slidably locked into shield end 400 when button 408 is pushed inward. Locking ring 409 can be made of metal such as steel. An optional spring 410 can be disposed around post 408*b* such that it compresses when the button 408 is pushed inward and expands when inward pressure on button 408 is released to provide a "pop-up" action for button 408.

Figure 9:
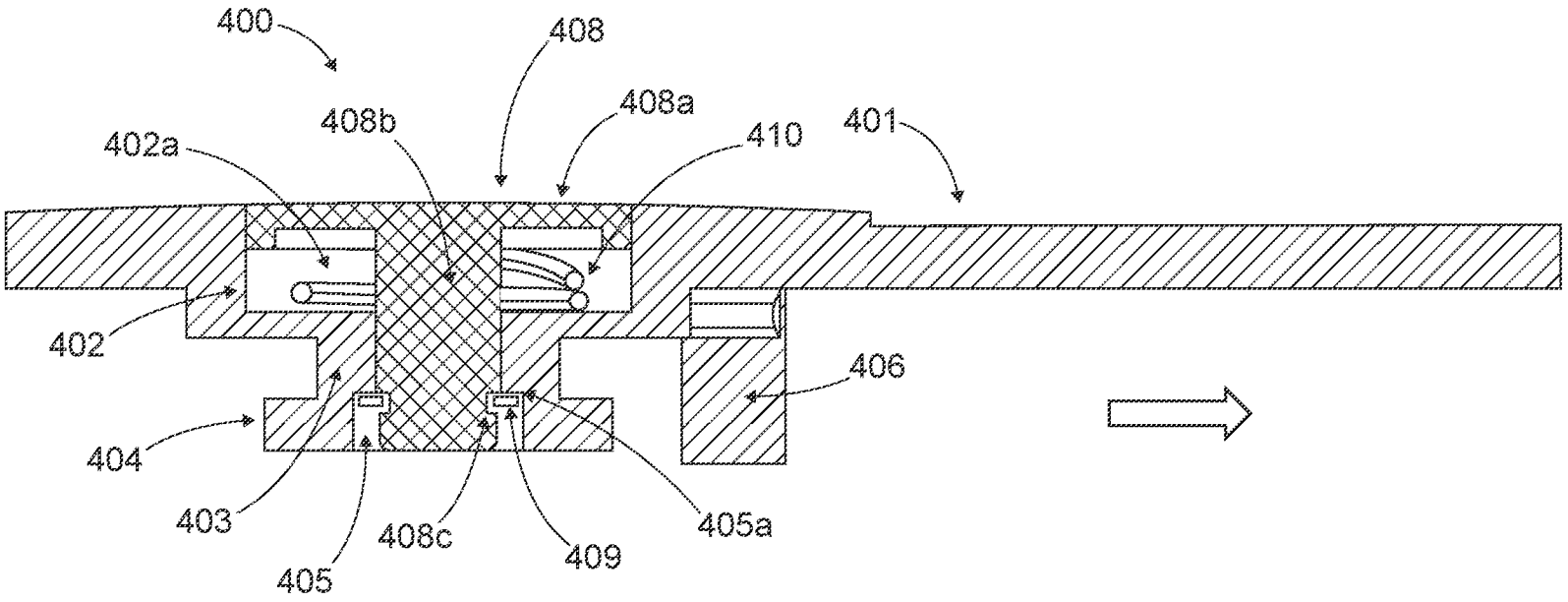
FIG. 9 shows a cross section view of a shield assembly, according to an exemplary embodiment of the disclosed subject matter.

FIG. 9 shows a cross section view of a shield assembly, according to an exemplary embodiment of the disclosed subject matter. In FIG. 9, button 408 is shown inserted into well 402 of the shield 400 and into the passage between well 402 and hole 405. It is held in the passage by locking ring 409, which is configured to engage the annular narrowing 405*a* at the top of hole 405 and the annular slot 408*c* on button post 408*b* so that button 408 cannot be removed. Spring 410 is shown in well 402 inward of button top 408*a*.

Figure 10:
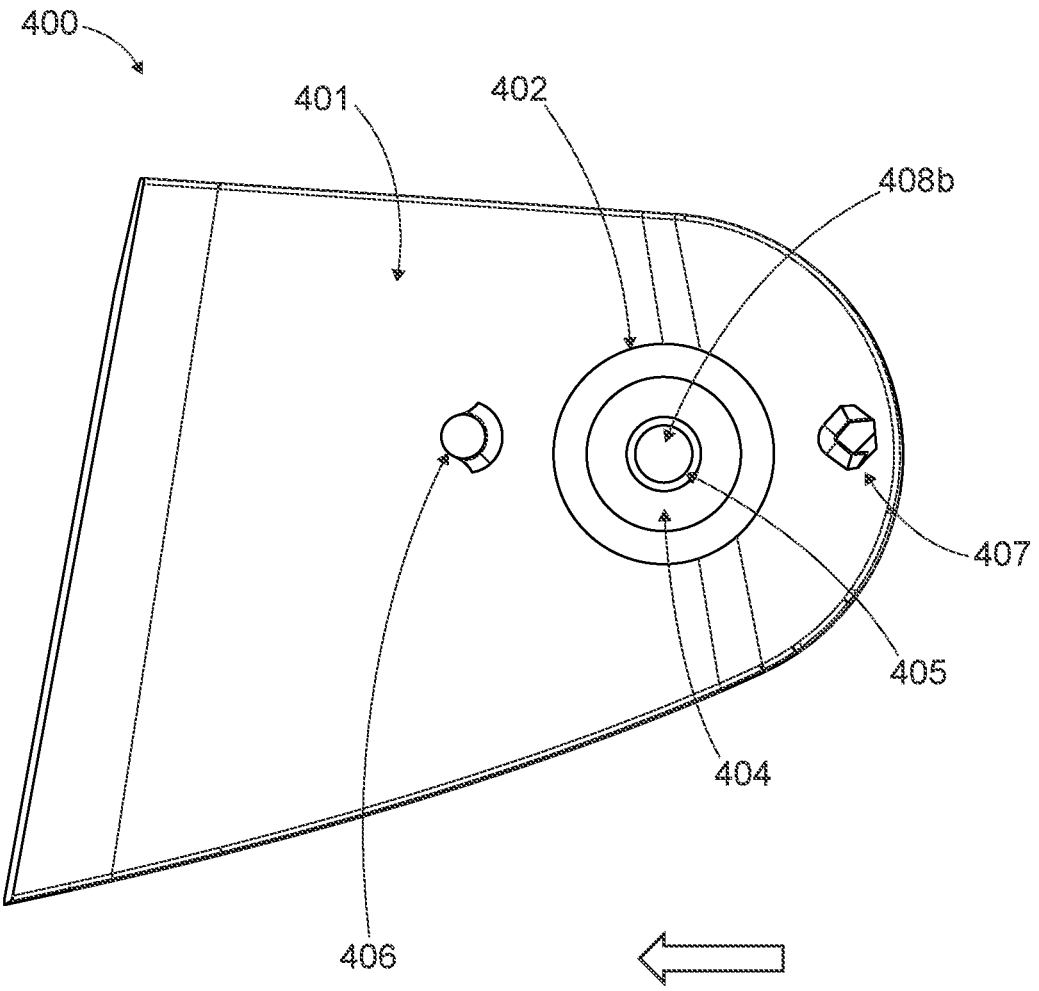
FIG. 10 shows a reverse side view of a shield assembly, according to an exemplary embodiment of the disclosed subject matter.

FIG. 10 shows a reverse side view of a shield assembly 400, viewed from the inside of a helmet. Shield end 400 comprises a generally flat region 401 that would extend into the curved region of a shield if shown. Button post 408*b* is shown inserted into hole 405, surrounded by pivot post flange 404. First detent post 406 is disposed on the inside face of shield end 400 forward of the pivot portion. Second detent post 407 is disposed on the inside face of shield end 400 rearward of the pivot portion. Detent posts 406 and 407 are shown at approximately diametrically opposed sides of the pivot region of the shield end.

Figure 11:
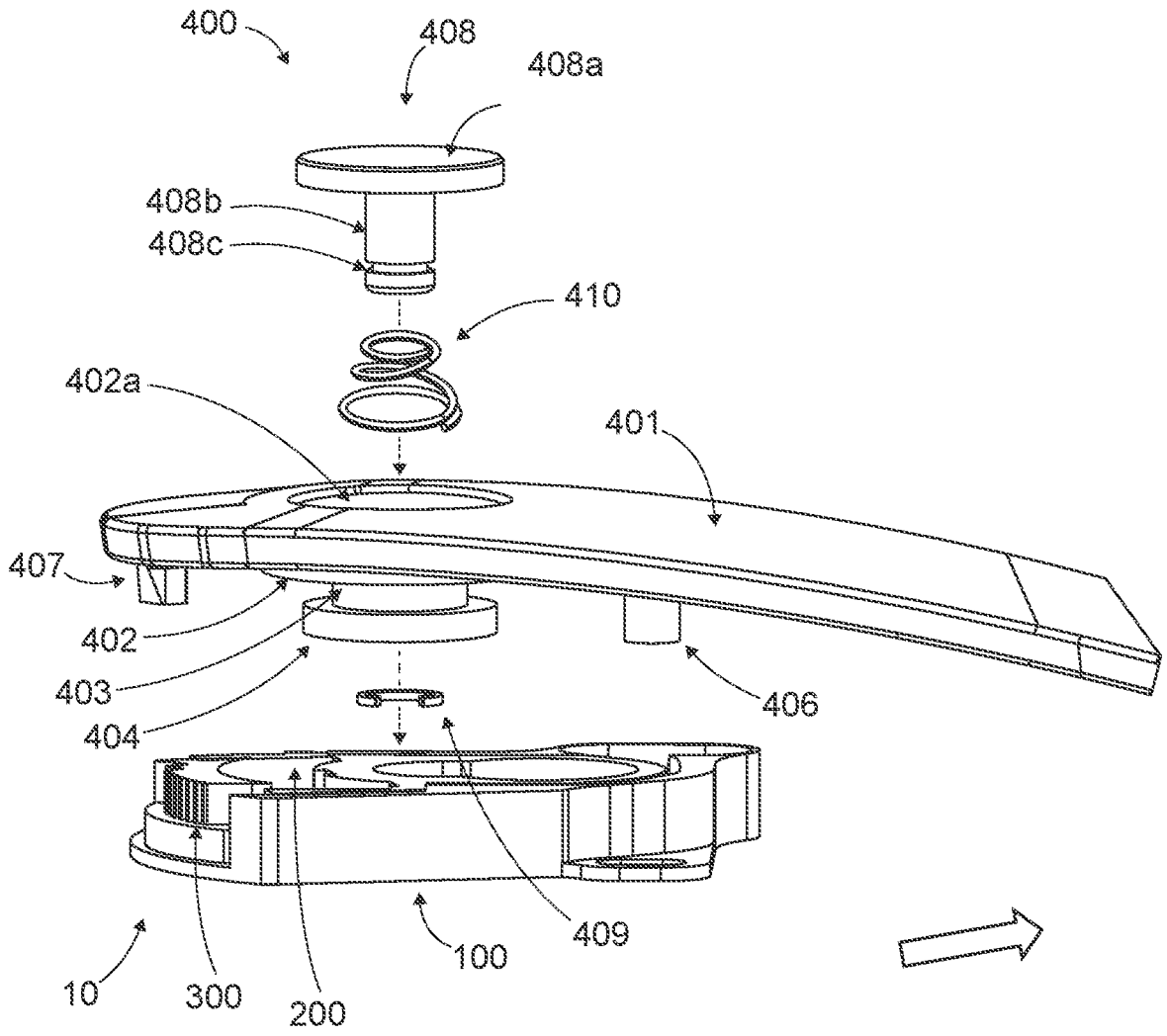
FIG. 11 shows an exploded view of a shield assembly and a pivot mechanism, according to an exemplary embodiment of the disclosed subject matter.

FIG. 11 shows an exploded view of the shield assembly and pivot mechanism 10, according to an exemplary embodiment. The shield assembly 400 is assembled as described above with regard to FIGS. 8, 9 and 10. To engage or load the shield end 400 into pivot mechanism 10, pivot flange 404 is inserted into the larger end 214*a* of keyhole 214 of pivot member 200, which is sized to allow pivot flange 404 to pass through into cavity 217 of pivot member 200. At the same time, detent post 406 is inserted into the forward end of detent well 107. Pivot flange 404 engages flanges 216*a* and 216*b* of panel 215 and pushes panel 215 inward (down in this view) into the hole 115 of base plate 100 (see FIG. 12). Optionally, pushing button 408 inward can facilitate pushing panel 215 inward. Moving the shield end 400 rearward (to the left in this view) moves pivot post 403 into the smaller end 214*b* of keyhole 214, which is sized to allow pivot post 403 to pass through but block pivot flange 404. Pivot flange 404 also clears past flanges 216*a* and 216*b* on panel 215, allowing panel 215 to re-align with the first surface 201*a* of pivot member 200. Flanges 216*a* and 216*b* engage the forward part of pivot flange 404, panel 215 engages the inward (bottom) face of pivot flange 404 and the inner face of second surface 201*b* of pivot member 200 engages to outward (upper) face of pivot flange 404, trapping it in cavity 217.

Figure 12:
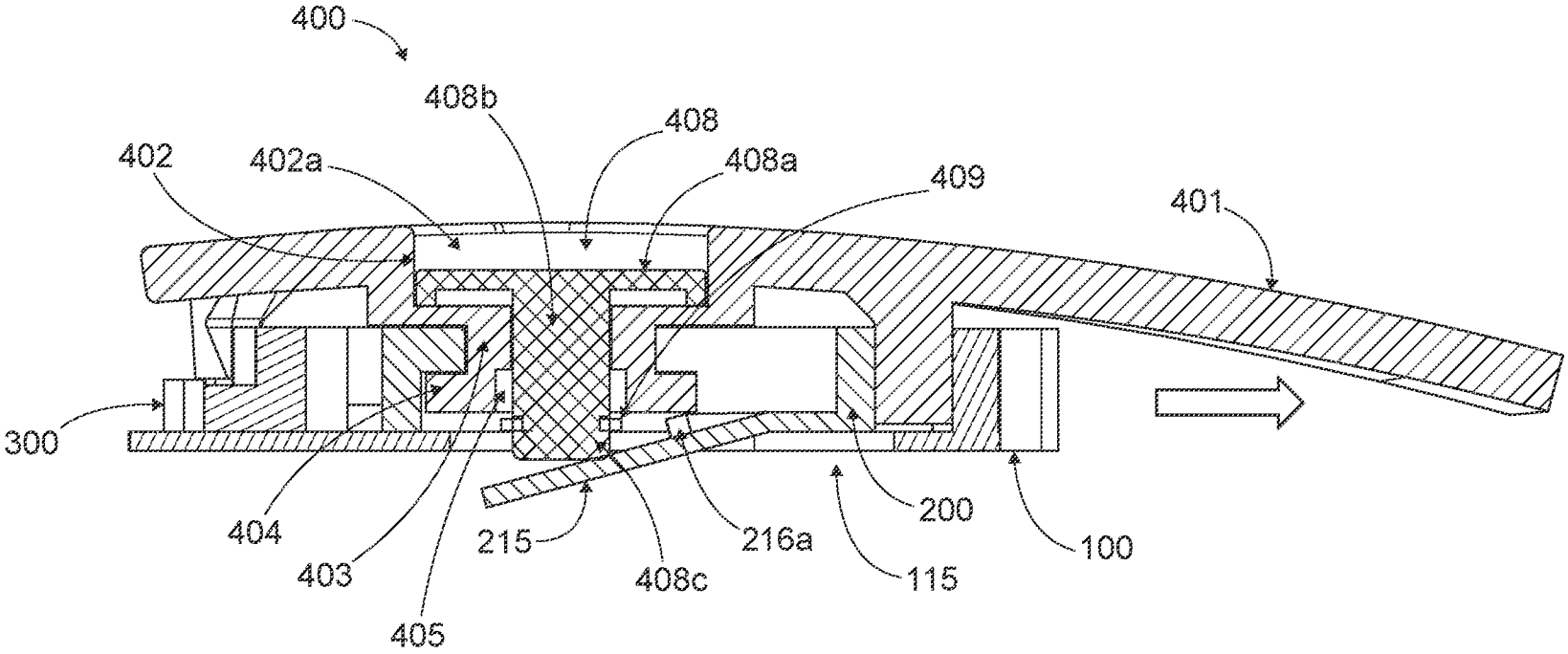
FIG. 12 shows a cross section view of a shield assembly inserted into a pivot mechanism, according to an exemplary embodiment of the disclosed subject matter.

FIG. 12 shows a cross section view of the shield assembly inserted into the pivot mechanism 10. In this view, button 408 is pushed inward, forcing panel 215 inward and attached flanges 216*a* and 216*b*, through hole 215 of base plate 100, providing clearance for pivot flange 404 to move within cavity 217. As discussed above, moving the pivot post 403 rearward engages the shield into the pivot mechanism 10. Moving 403 forward disengages the shield from the pivot mechanism 10.

Figure 13:
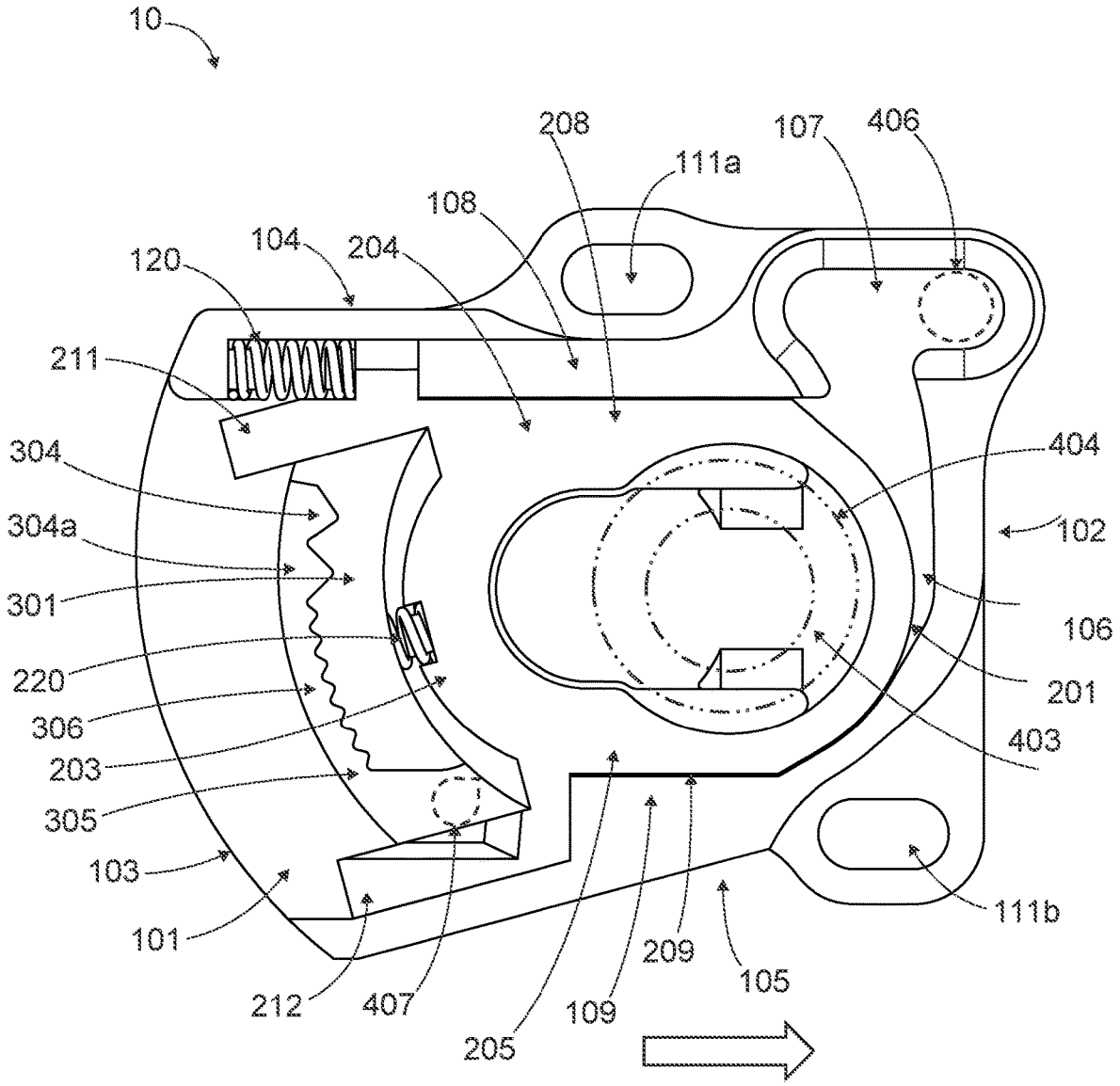
FIG. 13 shows an elevation view of a pivot mechanism showing the relative position of a shield inserted into a pivot mechanism in an engage/disengage configuration, according to an exemplary embodiment of the disclosed subject matter.

FIG. 13 shows an elevation view of pivot mechanism 10 showing the relative position of a shield inserted into the pivot mechanism in an engage/disengage configuration, according to an exemplary embodiment. For ease of illustration, the shield is not shown, but the positions of certain features of the shield are denoted with dashed lines. As described above, the shield end 400 is engaged to the pivot mechanism 10 by inserting the pivot post 403 and pivot flange 404 centered in the larger end 214*a* of keyhole 214, sized to allow pivot flange 404 to pass through. Detent post 406 is inserted into the forward end of detent well 107. Detent post 407 is disposed forwardly in detent position 305 adjacent to raised portion 301 of detent member 300. Moving the shield end 400 rearward locks the shield end 400 into the pivot mechanism 10 as shown in FIG. 14.

Figure 14:
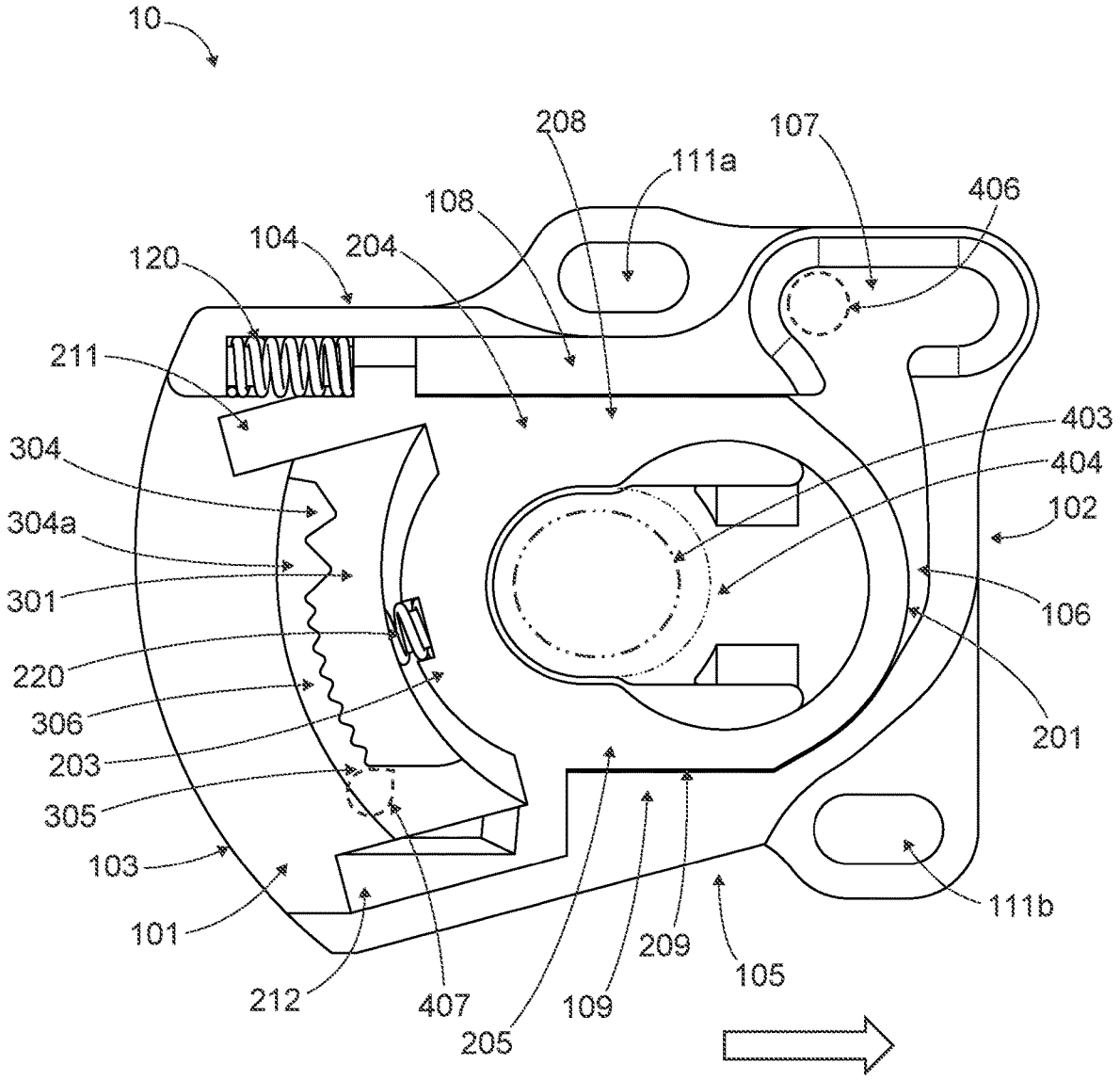
FIG. 14 shows an elevation view of a pivot mechanism showing the relative position of a shield inserted into a pivot mechanism in a raised configuration, according to an exemplary embodiment of the disclosed subject matter.

FIG. 14 shows an elevation view of pivot mechanism 10 showing the relative position of a shield inserted into the pivot mechanism 10 in a raised configuration, according to an exemplary embodiment. Typically, this disposition of the shield is used when the wearer is not riding a motorcycle at high speeds so that eye protection is not needed and ventilation of the wearer's face is desirable. In this view, the pivot post 403 is centered on the smaller end 214*b* of keyhole 214 and pivot flange 404 is engaged by flanges 216*a* and 216*b*, locking it into the cavity 217 of pivot member 200. Detent post 406 is disposed in the rear end of detent well 107. Detent post 407 is disposed rearwardly in detent position 305 adjacent to raised portion 301 and proximate to second end 303 of detent member 300. Pivot member 200 is disposed forward such that its first end 202 is in contact with the curved face 106 of base plate 100. Spring 120 is in an expanded configuration, holding pivot member 200 forward relative to base plate 100. Spring 220 is in a compressed configuration, urging detent member 300 rearward relative to base plate 100 so that it is tightly held against detent post 407. In the raised position, the shield is disposed proximate to the brow region of a helmet and exposing the eyes and/or face of a wearer of the helmet.

Figure 15:
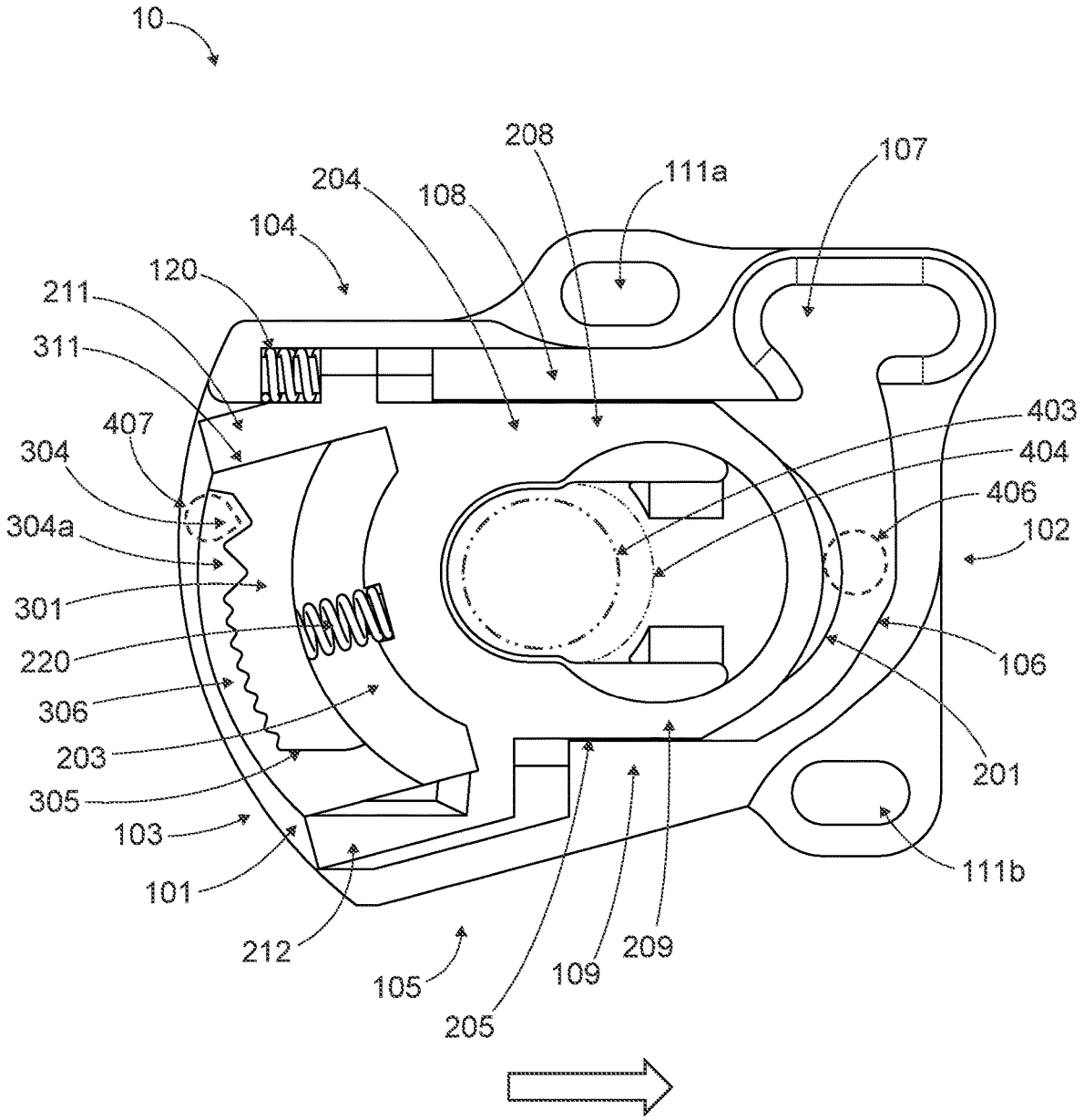
FIG. 15 shows an elevation view of a pivot mechanism showing the relative position of a shield inserted into a pivot mechanism in a lowered configuration, according to an exemplary embodiment of the disclosed subject matter.

FIG. 15 shows an elevation view of pivot mechanism 10 showing the relative position of a shield inserted into the pivot mechanism 10 in a lowered configuration, according to an exemplary embodiment. A user can rotate the shield downward from the raised configuration to this position. In the lowered position, the shield is disposed in front of the eyes and/or face of a wearer of the helmet. Typically, this disposition of the shield is used when the wearer is riding a motorcycle at high speeds so that eye protection is needed. In this view, the pivot post 403 is centered on the smaller end 214*b* of keyhole 214 and pivot flange 404 is engaged by flanges 216*a* and 216*b*, locking it into the cavity 217 of pivot member 200. Detent post 406 is disposed between the curved face 106 of base plate 100 and first end 202 of pivot member 200. Detent post 407 is disposed in detent position 304 of raised portion 301 proximate to the first end 302 of detent member 300. Pivot member 200 is disposed rearward relative to base plate 100 compared to the raised configuration illustrated in FIG. 14. Spring 120 is in a compressed configuration, urging pivot member 200 forward relative to base plate 100. Spring 220 is in an expanded configuration, urging detent member 300 rearward relative to base plate 100 so that it is tightly held against detent post 407. As a wearer moves the shield between the raised and lowered configurations, the spring 220 provides a force that urges rearward motion of the detent member 300 relative to pivot member 200. As the shield rotates, the detent post 407 pushes the detent member 300 forward against the spring 220 until detent post 407 enters a detent position, at which point the spring expands and pushes the detent member snugly against the detent post 407. This forces the detent member 300 against the detent post 407, so that it resists accidental movement of the detent post 407 along the curve of detent member 300. The plurality of small detent positions 306 between detent positions 304 and 305 provide additional points where the pivot mechanism can stop accidental rotational movement of the shield end. The alternate compressed/expanded configurations of springs 120 and 220 provide expansive forces that promote the pivot mechanism to hold the shield in a desired position unless deliberately moved by a user of the helmet.

Figure 16:
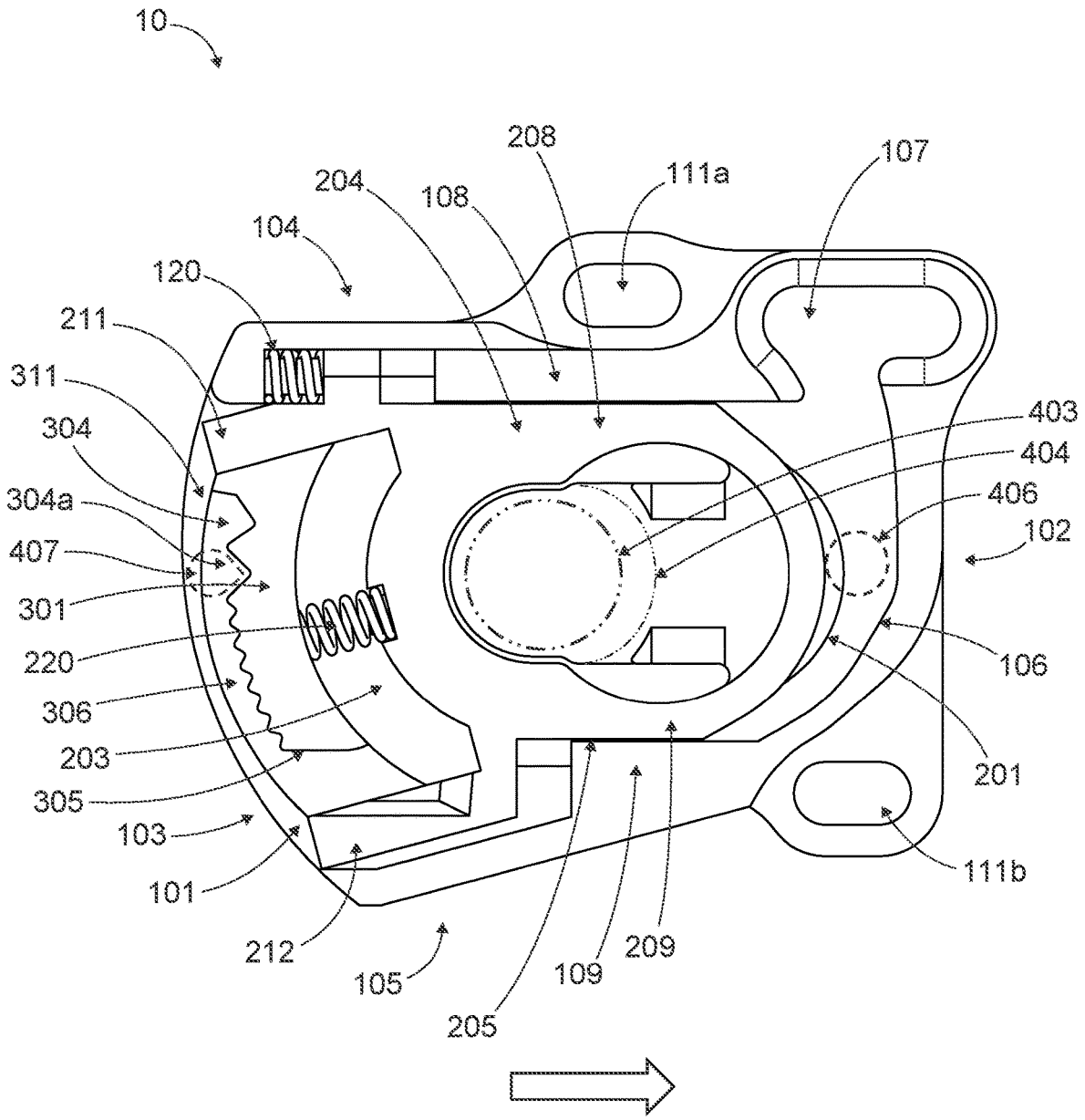
FIG. 16 shows an elevation view of a pivot mechanism showing the relative position of a shield inserted into a pivot mechanism in a vented configuration, according to an exemplary embodiment of the disclosed subject matter.

FIG. 16 shows an elevation view of a pivot mechanism showing the relative position of a shield inserted into a pivot mechanism in a vented configuration, according to an exemplary embodiment. As described above, it can be desirable to have the ability to vent the outer shield while keeping it in front of a wearer's face/eyes. In this view, detent post 406 is moved upward along curved face 106 of base plate 100 and detent post 407 is disposed in detent position 304*a*. Detent positions in this configuration rotate the shield about 10 degrees compared to its position in the lowered configuration.

Figure 17:
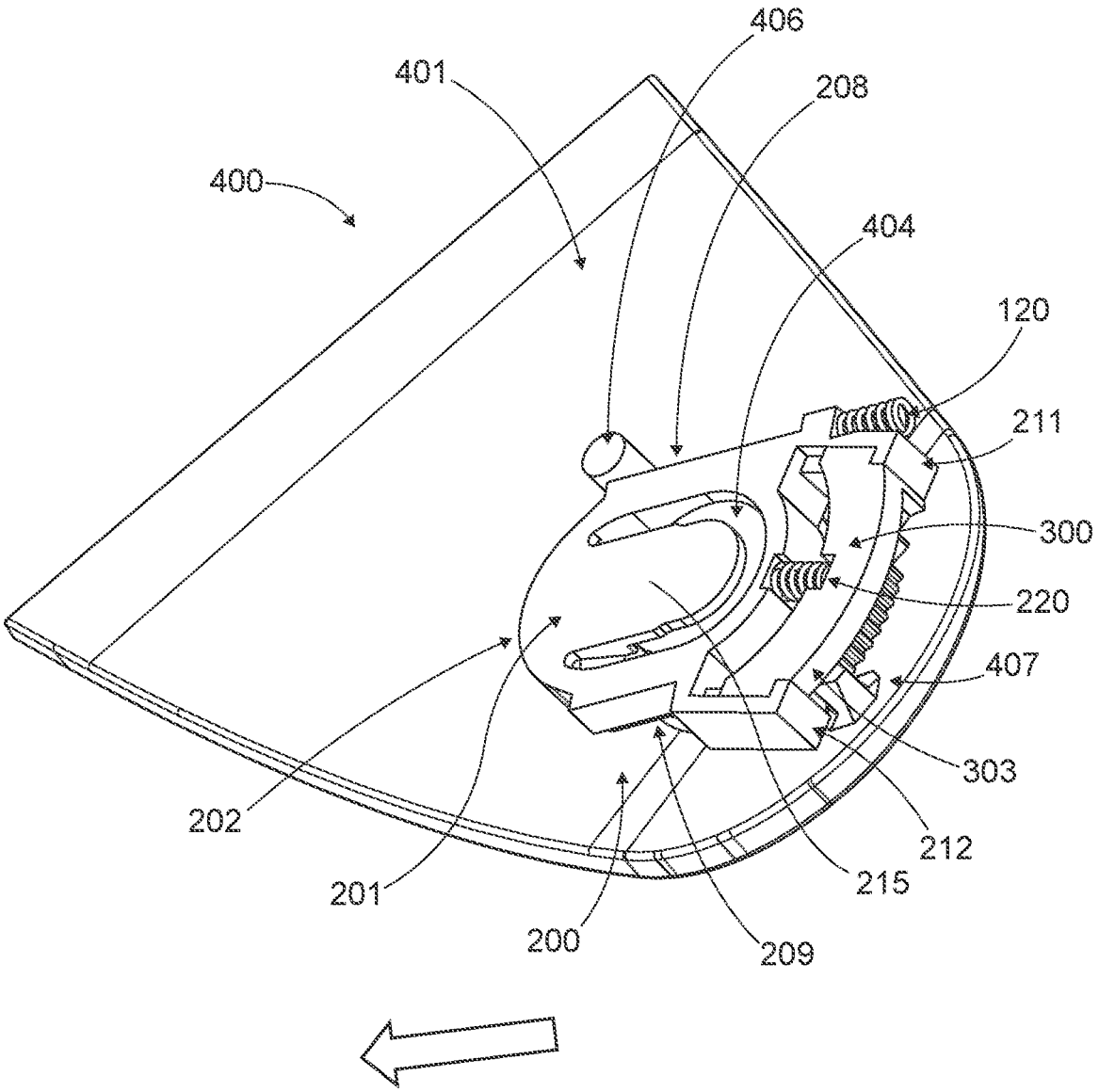
FIG. 17 shows perspective view of a pivot mechanism and shield wherein the shield is in a raised configuration, according to an exemplary embodiment of the disclosed subject matter.

FIG. 17 shows a perspective view of a pivot mechanism 10 and shield 400 wherein the shield 400 is in a raised configuration, according to an exemplary embodiment. The perspective is from the interior of the helmet looking toward the right side of a helmet containing the pivot mechanism 10. In this view, the base plate 100 is removed for ease of illustration. Detent post 406 is shown disposed near the upper corner of first end 202 of pivot member 300. Detent post 407 is shown disposed near the second end 303 of detent member 200. Spring 120 is shown as expanded, indicative of pivot member 200 moved forward relative to base plate 100.

Figure 18:
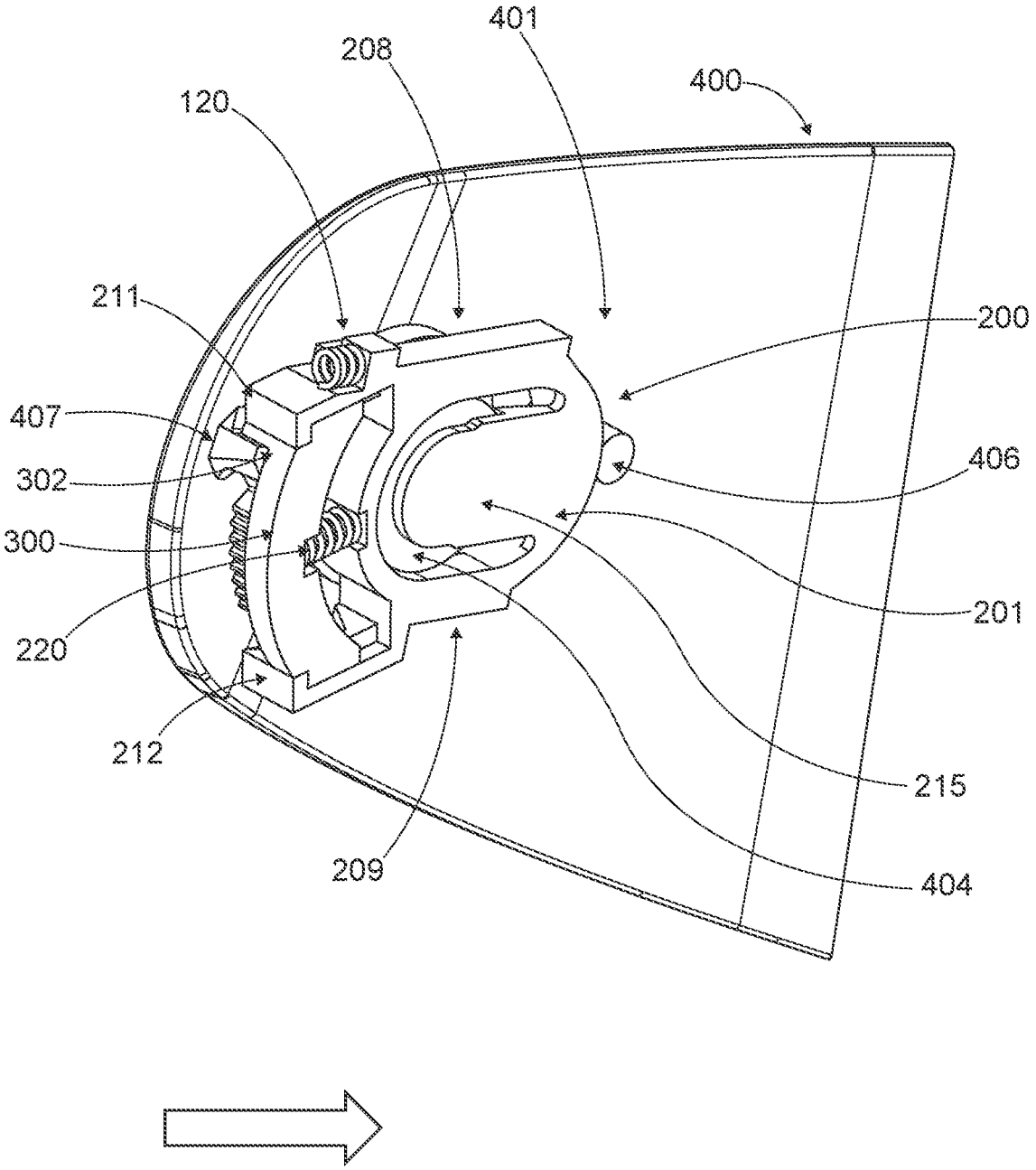
FIG. 18 shows a perspective view of a pivot mechanism and shield wherein the shield is in a lowered configuration, according to an exemplary embodiment of the disclosed subject matter.

FIG. 18 shows a perspective view of a pivot mechanism and shield wherein the shield is in a lowered configuration, according to an exemplary embodiment of the disclosed subject matter. The perspective is from the interior of the helmet looking toward the left side of a helmet containing the pivot mechanism 10. In this view, the base plate 100 is removed for ease of illustration. Detent post 406 is shown disposed near the center of first end 202 of pivot member 200. Detent post 407 is shown disposed near the first end 303 of detent member 300. Spring 120 is shown as compressed, indicative of pivot member 200 moved rearward relative to base plate 100.

Figure 19A:
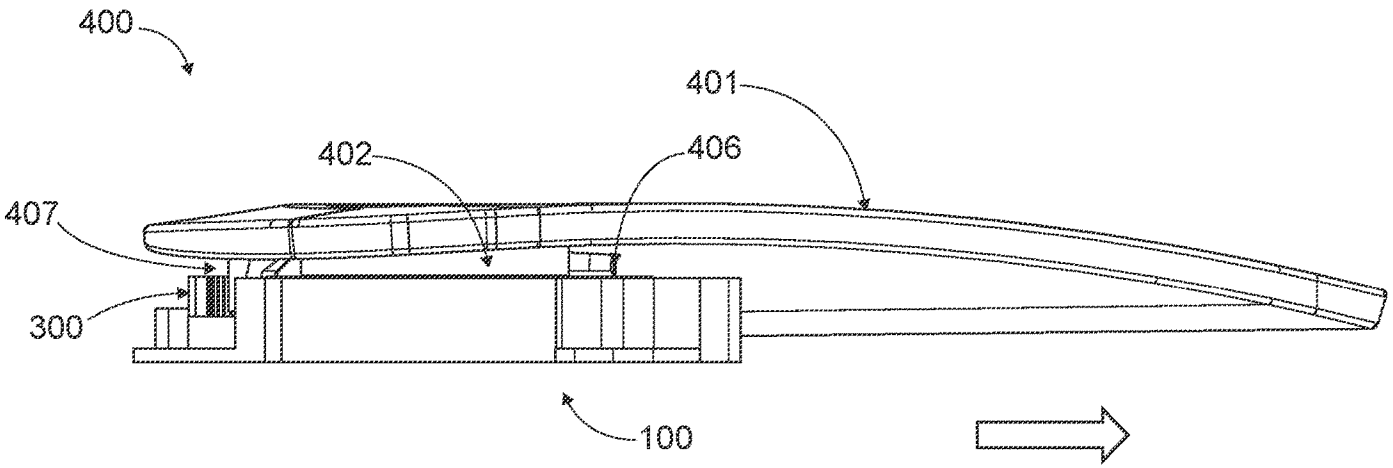
FIGS. 19A and 19B shows bottom views of a pivot mechanism and shield wherein the shield is in raised and lowered configurations, respectively, according to an exemplary embodiment of the disclosed subject matter.
Figure 19B:
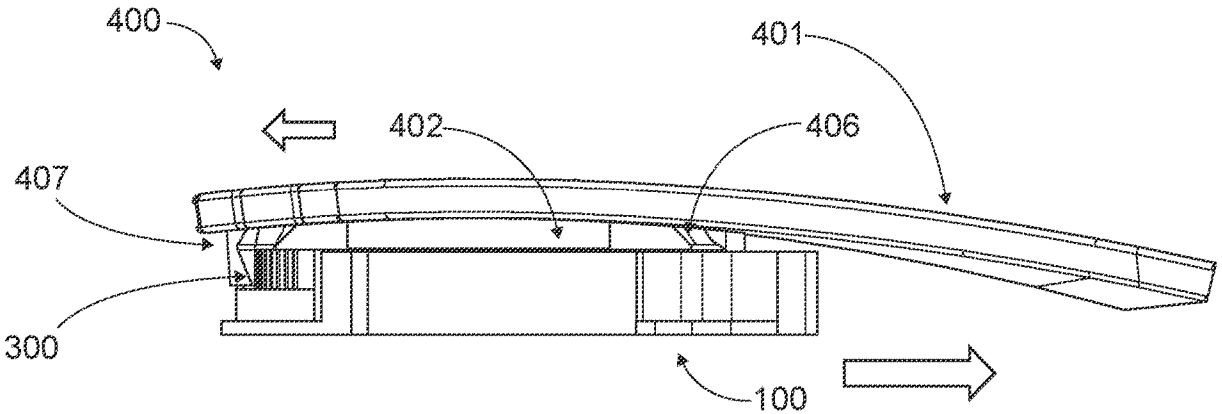

FIGS. 19A and 19B shows bottom views of a pivot mechanism and shield wherein the shield is in raised and lowered configurations, respectively, according to an exemplary embodiment. In FIG. 19A, detent post 406 and detent post 407 are shown disposed in detent well 107 of base plate 100 and detent position 305, respectively, indicative of the shield 400 being in its raised configuration. In FIG. 19B, detent post 406 is shown moved to the front end of base plate 100 and detent post 407 is shown disposed in detent position 304, indicative of the shield 400 being in its lowered configuration. Comparison of FIG. 19B to FIG. 19A shows that well 402 on shield 400 is moved rearward (to the left in this view) relative to base plate 100. It also shows that detent member 300 is also moved rearward relative to base plate 100. Since both well 402 and detent member 300 are engaged to pivot member 200 (not visible in this view), they indicate that pivot member 200 has also moved rearward relative to base plate 100. This rearward movement is indicated by the dotted arrow.

The hingeplate shown in FIGS. 1 through 19B show embodiments of a hingeplate 10 that provides rotational translation and rearward translation of a shield 400 engaged to hingeplate 10. The following figures show embodiments of a hingeplate 50 that provides rotational translation, rearward translation and inward translation of a shield 400 engaged to hingeplate 10.

Figure 20:
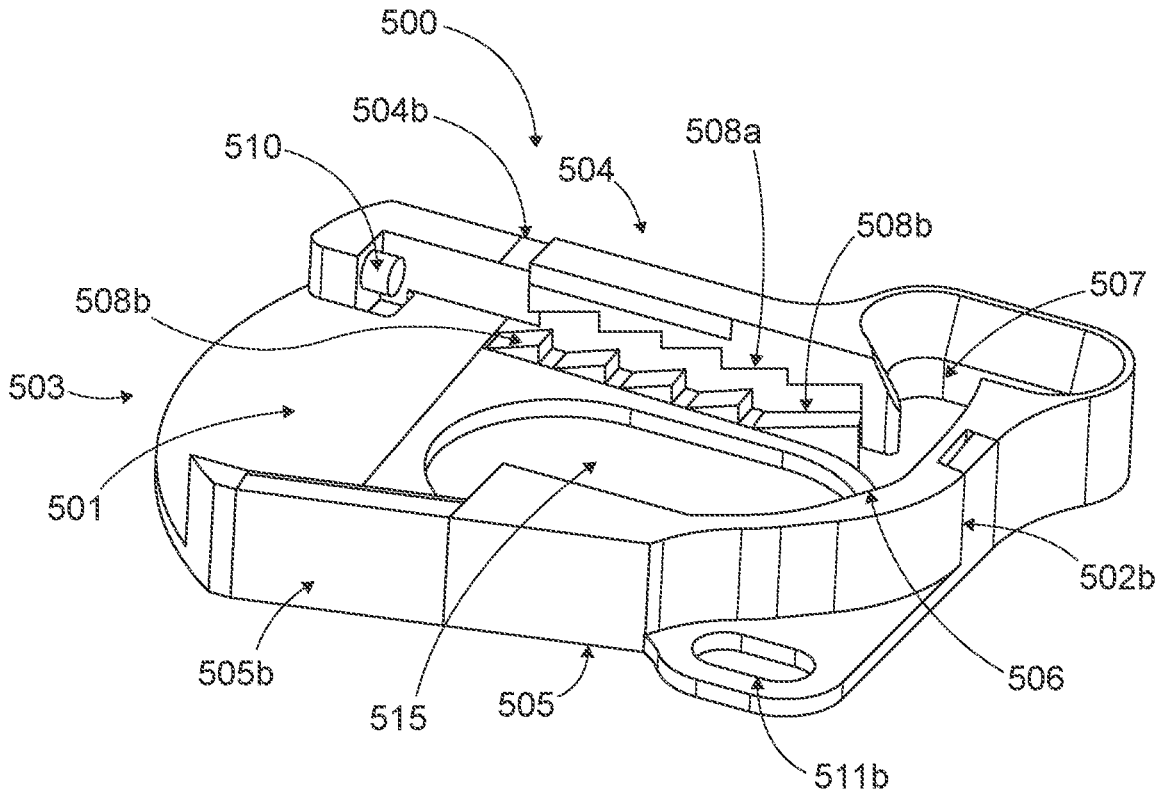
FIG. 20 shows a perspective view of a baseplate of a pivot mechanism, according to an exemplary embodiment of the disclosed subject matter.

FIG. 20 shows a perspective view of a base plate 500 of pivot mechanism 50, according to an exemplary embodiment. The base plate 500 is configured to be attached to an outer shell of the helmet (not shown). In this view, the baseplate is viewed from the outside of the right side of the helmet. The base plate 500 comprises a planar region 501 having a first surface, a second surface, a first end 502, a second end 503, a first side 504 and a second side 505. The base plate 500 comprises a raised portion proximate the first end 502 defining a curved face 506, a raised portion 508 proximate the first side 504, a raised portion 509 proximate the second side 505, wherein a portion of the raised portion 508 proximate the first side 504 and a portion of the raised portion 509 proximate the second side 505 are disposed parallel to each other and define stepped tracks. In the view shown, upper portion 508*a* and lower portion 508*b* of raised portion 508 define a track comprising a plurality of ramp segments that slope downward toward the rear of base plate 500 and define a stepped groove in raised portion 508. A similar groove is defined in the raised portion 509, not visible in this view. Features 502*b*, 504*b* and 505*b* are portions of the base plate 50 related to its two-part construction illustrated in FIGS. 21 and 22. The raised portions 506 and 508 also define a detent well 507 at the upper front corner of the baseplate. A detent post 510 is disposed at the upper rear corner of the baseplate. Through-holes 511*a* and 511*b* provide loci where the base plate 500 can be fixed to the shell of the helmet, using screws, rivets or other fasteners (not shown). An elongate hole 515 is disposed in the planar region 501. The stepped grooves in raised portions 508 and 509 are the major difference between base plate 100 and base plate 500. All other features are essentially identical between base plates 100 and 500 and provide the same functionality.

Figure 21:
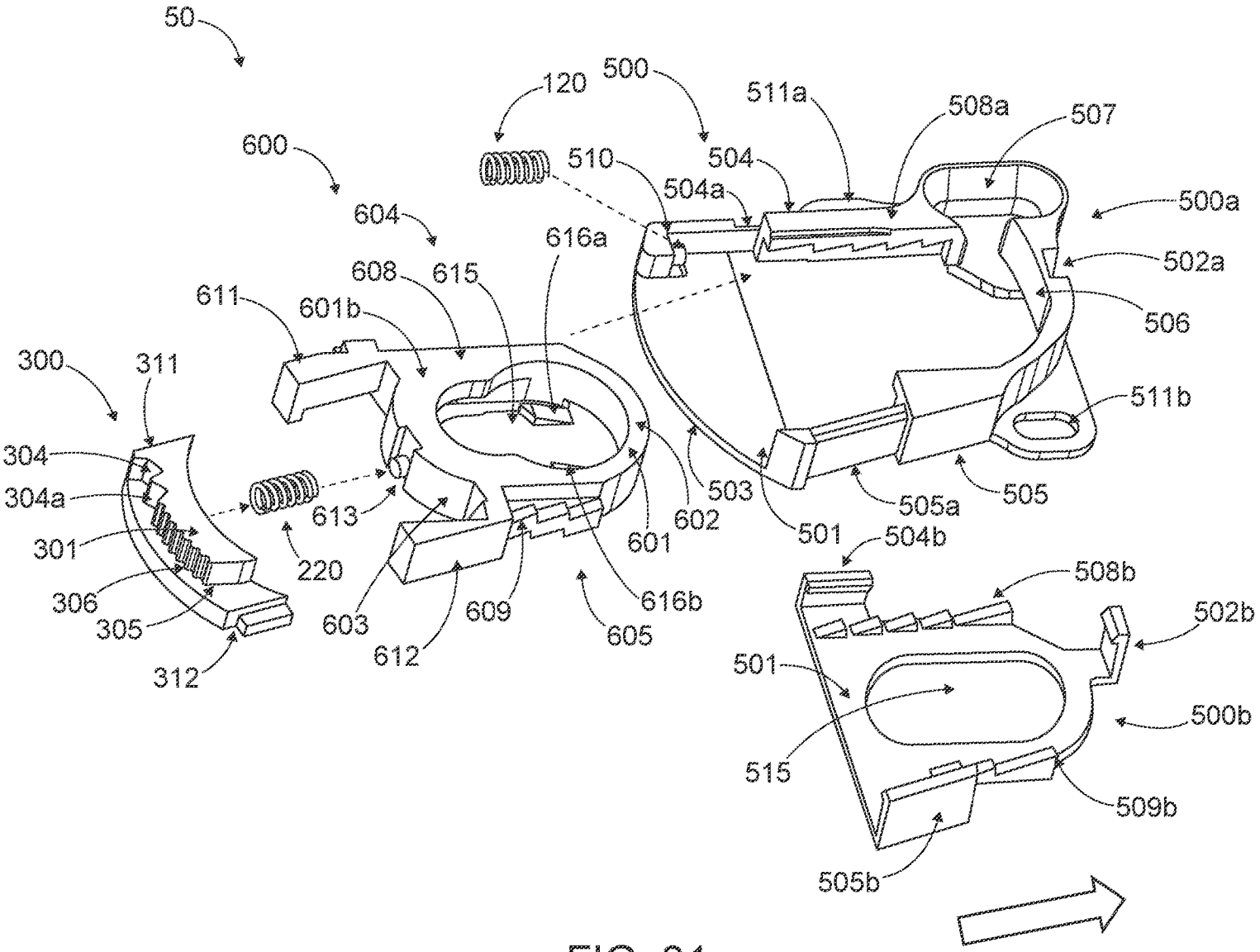
FIG. 21 shows a perspective exploded view of a pivot mechanism, according to an exemplary embodiment of the disclosed subject matter.

FIG. 21 shows a perspective exploded view of pivot mechanism 50, according to an exemplary embodiment. This figure shows that for ease of fabrication, base plate 50 is molded in two separate parts 500*a* and 500*b*. These parts can be clipped together by raised portions 502*b*, 504*b* and 505*b* on lower base plate 500*b* engaging complementary recesses 502*a*, 504*a* and 505*a* on upper base plate 500*a*. Flanges on 502*b*, 504*b* and 505*b* facilitate this engagement.

Also shown in FIG. 21 is pivot member 600 comprising a main body 601 having a first surface 601*a*, a second surface 601*b*, a first end 602, a second end 603, a first side 604 and a second side 604, configured to be engaged to a pivot post of a shield. The first side 604 and a second side 605 each have a stepped rail, 608 (not shown in this view) and 609 respectively, configured to engage the stepped track recesses in raised portions 508 and 509 proximate the respective first side 504 and second side 505 of the base plate 500. The first side 604 and the second side 605 each have extensions, 611 and 612 respectively, that extend beyond the second end 605 defining a space therebetween. The pivot member 600 also comprises a detent post 610 proximate to the first side 604 that is configured to engage a first resilient member, spring 120. The pivot member 600 also comprises a detent post 613 proximate to the second end 603 that is configured to engage a first end of a second resilient member, coil spring 220. The second surface 601*b* comprises a keyhole opening 614 having a wide dimension 614*a* proximate the first end 602 of main body 601 and a narrow dimension 614*b* proximate the second end 603 of main body 601. A panel 615 having flanges 616*a* and 616*b* can be seen through keyhole opening 614.

The stepped rails in 608 and 609 are the major difference between pivot member 200 shown in FIGS. 2 through 5 and pivot member 600. All other features are essentially identical between pivot members 200 and 600 and provide the same functionality.

FIG. 21 also shows curved detent member 300, spring 120 and spring 220 that are identical to and function the same as those features described above with regard to FIG. 2.

Figure 22:
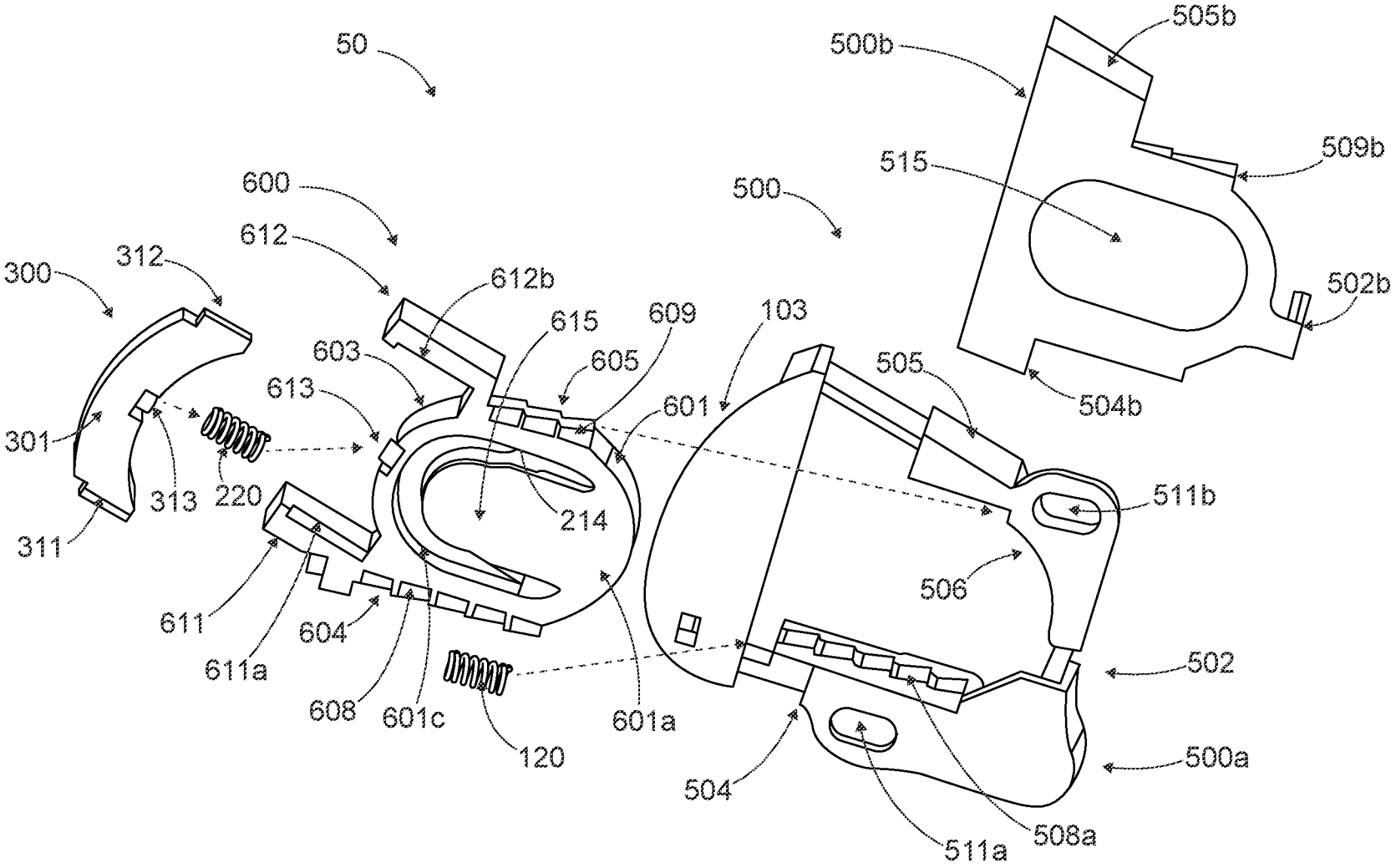
FIG. 22 shows a perspective exploded view of a pivot mechanism, according to an exemplary embodiment of the disclosed subject matter.

FIG. 22 shows a perspective exploded view of pivot mechanism 50 showing the opposite face from that shown in FIG. 21, according to an exemplary embodiment. Rabbet 611*a* on the projection 611 is shown, configured to be slidingly engaged by the flange 311 on detent member 300. A similar rabbet, 612*a*, is configured to be slidingly engaged by the flange 312 on detent member 300. These rabbets are configured to be in parallel so that detent member 300 can move forward and backward relative to pivot member 600 along tracks defined by the rabbets.

The first surface 601*a* of the main body 601 comprises a panel 615 attached to the pivot member 600 proximate to the first end 602 at the panel 615's first end. A curved slot 601*c* in the first surface 601*a* separates the sides and the second (free) end of the panel 215 from the first surface. Seen behind panel 615 through slot 601*c* is opening 614 in the second surface 601 of pivot member 600. Panel 615 is sized so that the second (free) end can pass through hole 515 in base plate 500 when pushed inward by a projection of a shield inserted into opening 614.

Figure 23:
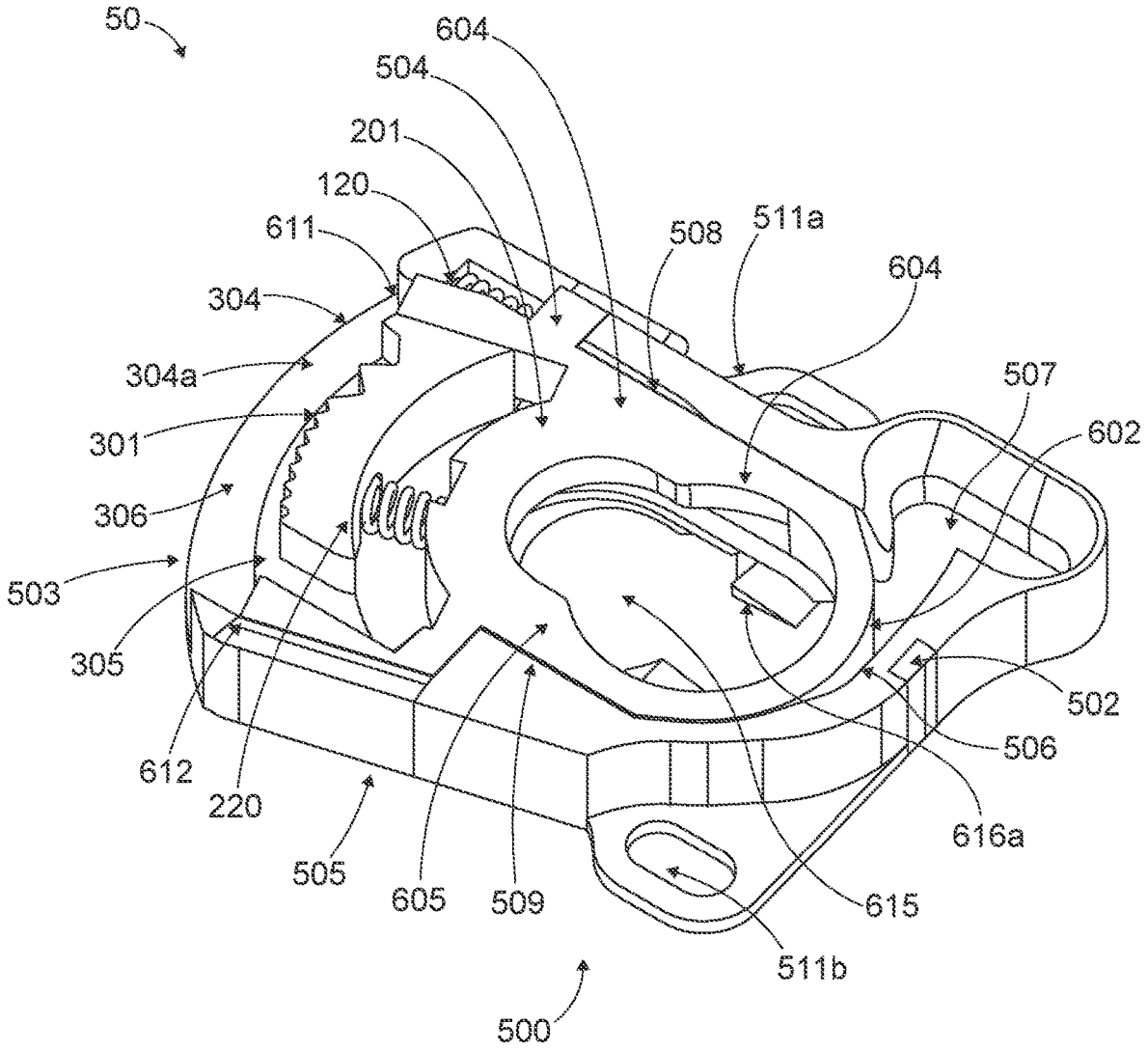
FIG. 23 shows a perspective view of an assembled pivot mechanism, according to an exemplary embodiment of the disclosed subject matter.

FIG. 23 shows a perspective assembled view of pivot mechanism 50, according to an exemplary embodiment. When assembled, the stepped tracks and stepped rails are disposed within the pivot mechanism 50 and cannot be seen. Pivot mechanism 50 functions essentially the same as pivot mechanism 10 to translate the shield 400 rotationally and rearward when the shield is moved from a raised configuration to a lowered configuration, while additionally providing for inward translation of the shield.

Figure 24A:
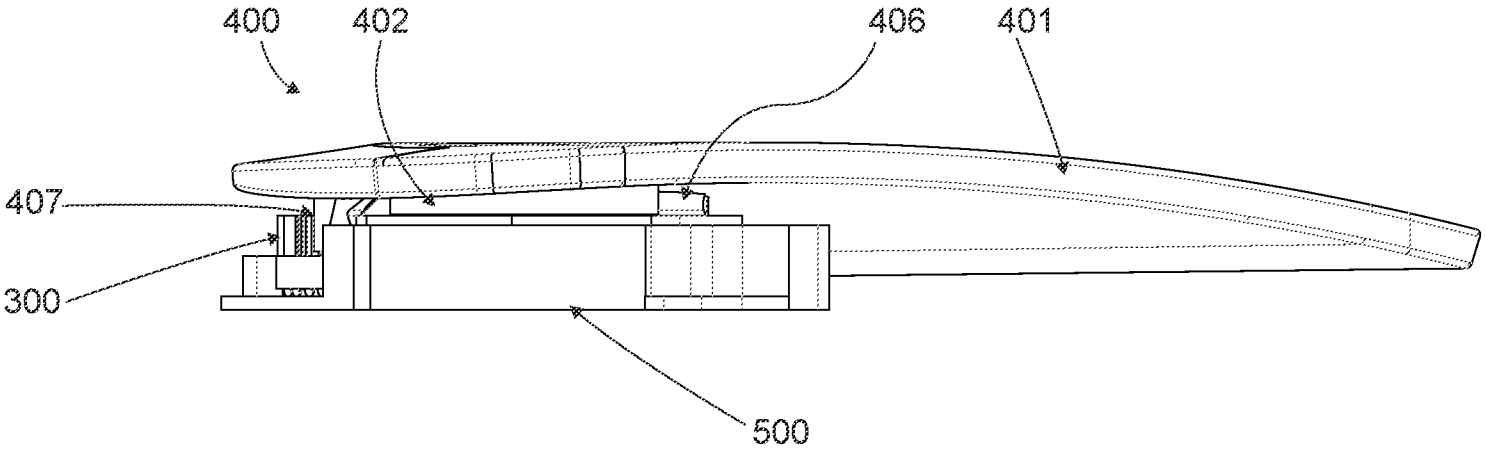
FIGS. 24A and 24B show views of a pivot mechanism and shield wherein the shield is in raised and lowered configurations, respectively, according to an exemplary embodiment of the disclosed subject matter.
Figure 24B:
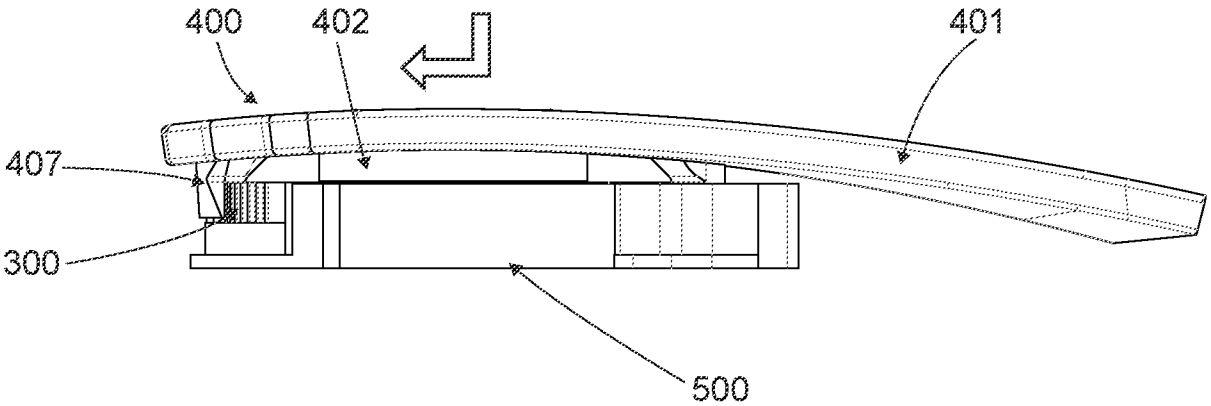

FIGS. 24A and 24B show bottom views of pivot mechanism 50 and shield wherein the shield is in raised and lowered configurations, respectively, according to an exemplary embodiment of the disclosed subject matter. In FIG. 24A, detent post 406 and detent post 407 are shown disposed in detent well 107 of base plate 500 and detent position 305, respectively, indicative of the shield 400 being in its raised configuration.

In FIG. 24B, detent post 406 is shown moved to the front end of base plate 500 and detent post 407 is shown disposed in detent position 304, indicative of the shield 400 being in its lowered configuration. Comparison of FIG. 24B to FIG. 24A shows that well 402 on shield 400 is moved rearward (to the left in this view) and inward (down in this view) relative to base plate 500. It also shows that detent member 300 is also moved rearward relative to base plate 500. Since both well 402 and detent member 300 are engaged to pivot member 600 (not visible in this view), they indicate that pivot member 600 has also moved rearward relative to base plate 500. This rearward movement is indicated by the dotted arrow.

Figure 25A:
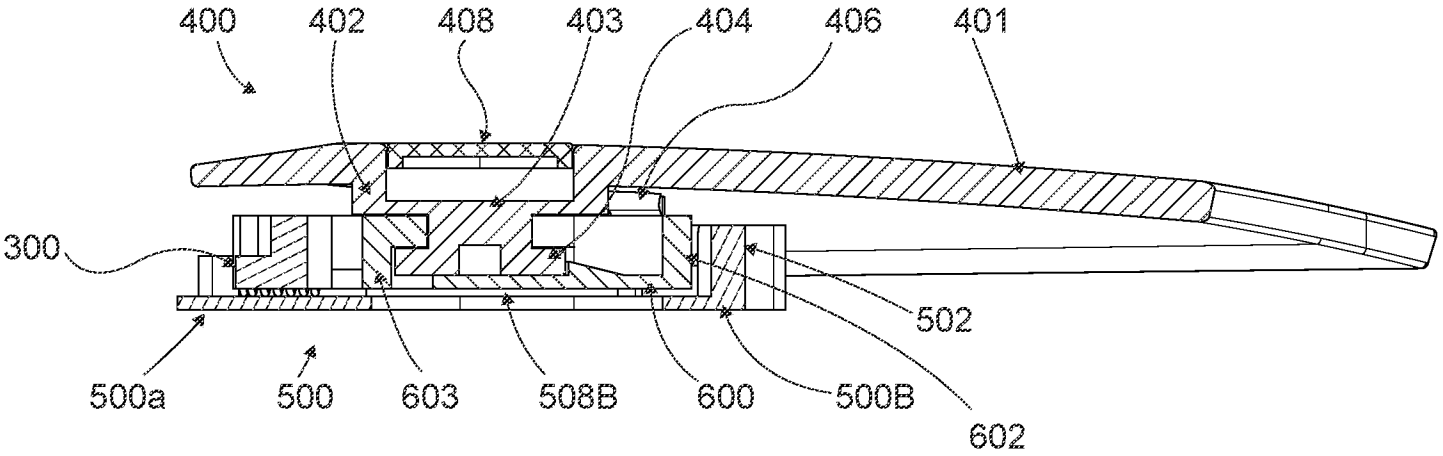
FIGS. 25A and 25B show section views of a pivot mechanism wherein the shield is in raised and lowered configurations, respectively, according to an exemplary embodiment of the disclosed subject matter.
Figure 25B:
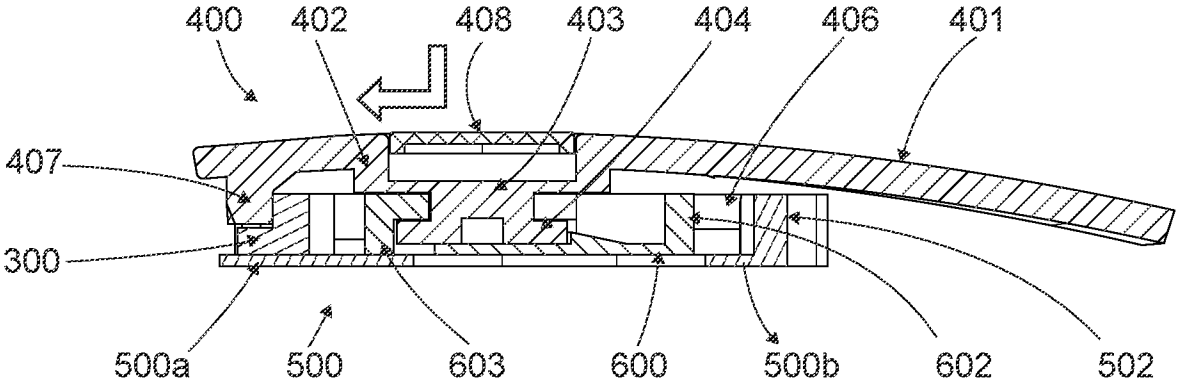

FIGS. 25A and 25B show section views of pivot mechanism 50 and shield 400 wherein the shield 400 is in raised and lowered configurations, respectively. In FIG. 25A, detent post 406 is shown disposed in detent well 507 of base plate 500 indicative of the shield 400 being in its raised configuration. Pivot member first end 602 is disposed close to curved face 506 at the front end 502*b* of base plate 500, indicative of it being in a forward position relative to base plate 500. Shield pivot post 403 and pivot flange 404 are disposed within pivot member 600 proximate to its second end 603. Pivot member 600 and shield 400 engaged thereto are shown disposed in an outward configuration, indicated by the stepped track 508*b* visible between pivot member 600 and the inward portion of base plate 500.

In FIG. 25B, detent post 406 is shown moved proximate to the front end 502 of base plate 500 and detent post 407 is shown disposed in detent position 304, indicative of the shield 400 being in its lowered configuration. Comparison of FIG. 25B to FIG. 25A shows that well 402 on shield 400 and second end 603 of pivot member 600 are moved rearward (to the left in this view) relative to base plate 500. It also shows that detent member 300 is also moved rearward relative to base plate 500. Shield body 401 is shown closer to base plate 500 than it is shown in FIG. 25A. Pivot member 600 is also moved inward, obscuring the stepped track 508*b*. These dispositions indicate that in this embodiment of a pivot mechanism, pivot mechanism provides for both rearward and inward translation of the pivot position for shield 400 when the shield is pivoted from a raised to a lowered position. These rearward and inward movements are indicated by the dotted arrow.

Figure 26A:
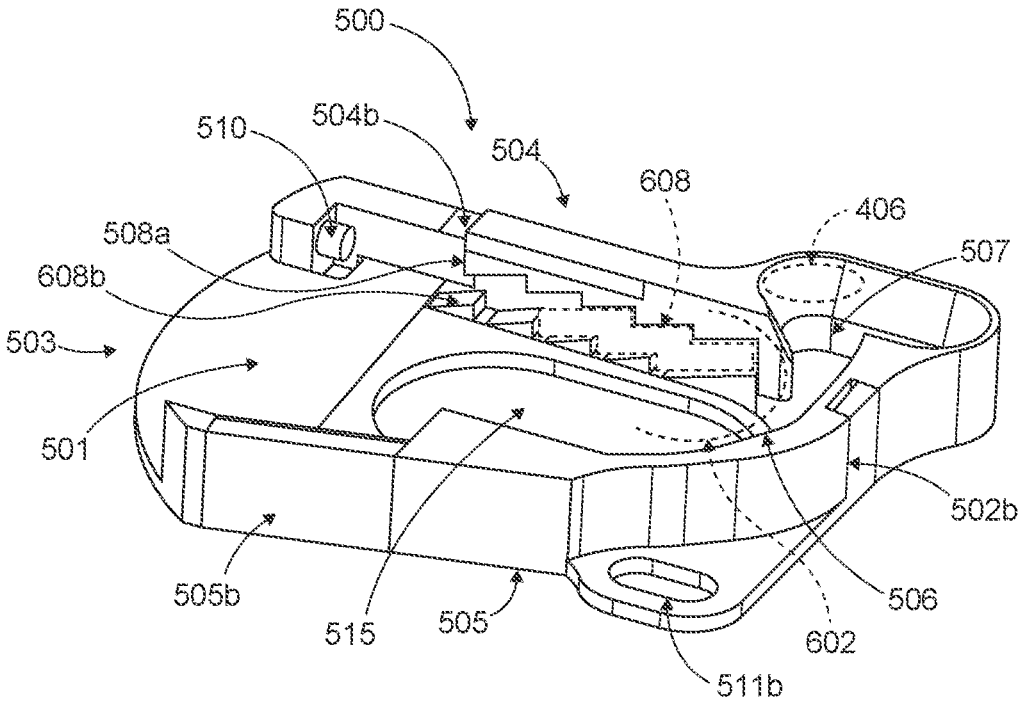
FIGS. 26A and 26B show views of a pivot mechanism baseplate wherein the shield is in raised and lowered configurations, respectively, according to an exemplary embodiment of the disclosed subject matter.
Figure 26B:
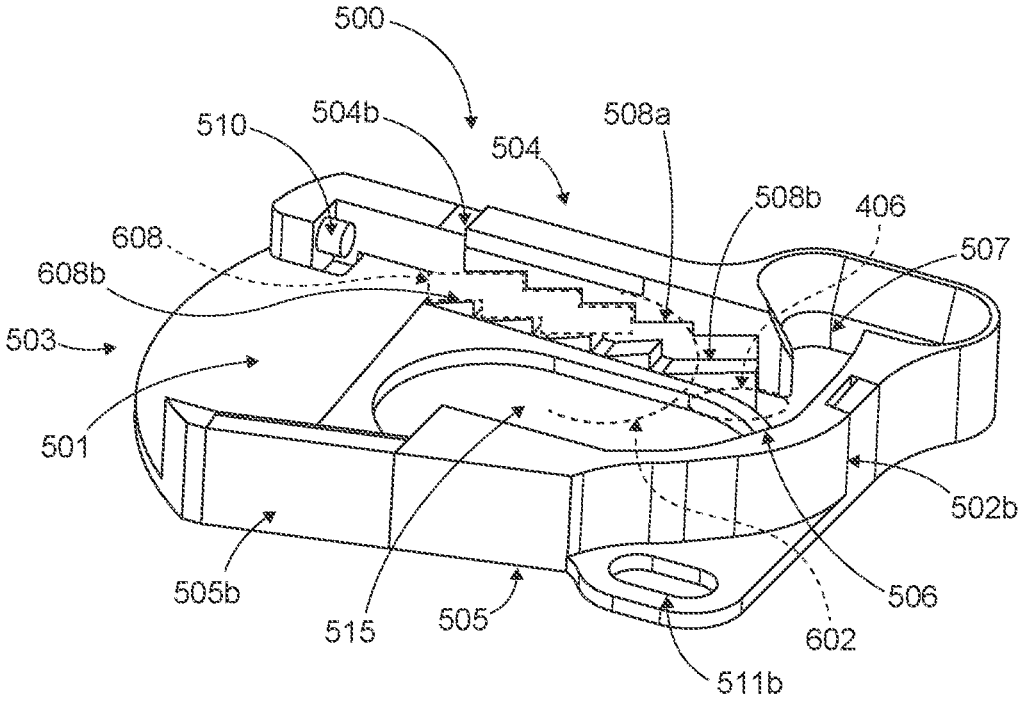

FIGS. 26A and 26B show views of pivot mechanism baseplate 500 when the shield 400 is in raised and lowered configurations, respectively. In the raised shield position, the position of stepped rail 608 of pivot member 600 is disposed forward in the stepped track defined by 508*a* and 508*b* at the dashed outline. Similarly, stepped rail 609 of pivot member 600 is disposed forward in the stepped track defined by 509*a* and 509*b* (not visible in this view). Detent post 406 is disposed in detent well 507 of base plate 500, as indicated by the dashed oval. Pivot member first end 602 is disposed proximate to curved face 506 at the front end 502*b* of base plate 500 as indicated by the dashed curved line, in a forward position relative to base plate 500.

In FIG. 26B, when the shield is in the lowered position, the position of stepped rail 608 of pivot member 600 is disposed rearward in the stepped track defined by 508*a* and 508*b* indicated by the dashed outline. Detent post 406 is disposed proximate the curved face 506 of base plate 500, as indicated by the dashed oval. Pivot member first end 602 is separated from curved face 506 by detent post 406 at the front end 502*b* of base plate 500 as indicated by the dashed curved line, in a rearward position relative to base plate 500.

Figure 27A:
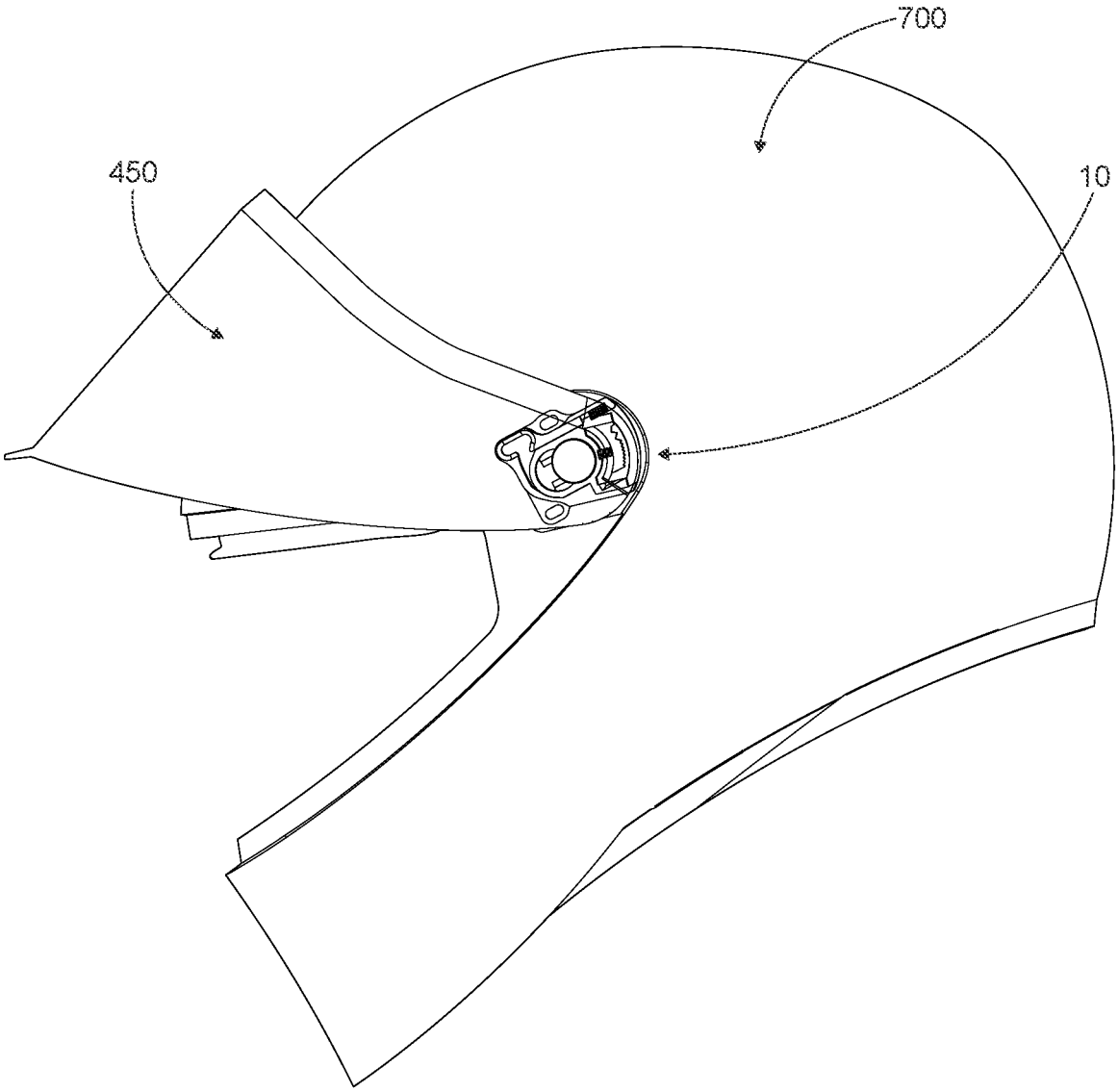
FIGS. 27A and 27B show views of a helmet comprising a pivot mechanism and shield wherein the shield is in raised and lowered configurations, respectively, according to an exemplary embodiment of the disclosed subject matter.
Figure 27B:
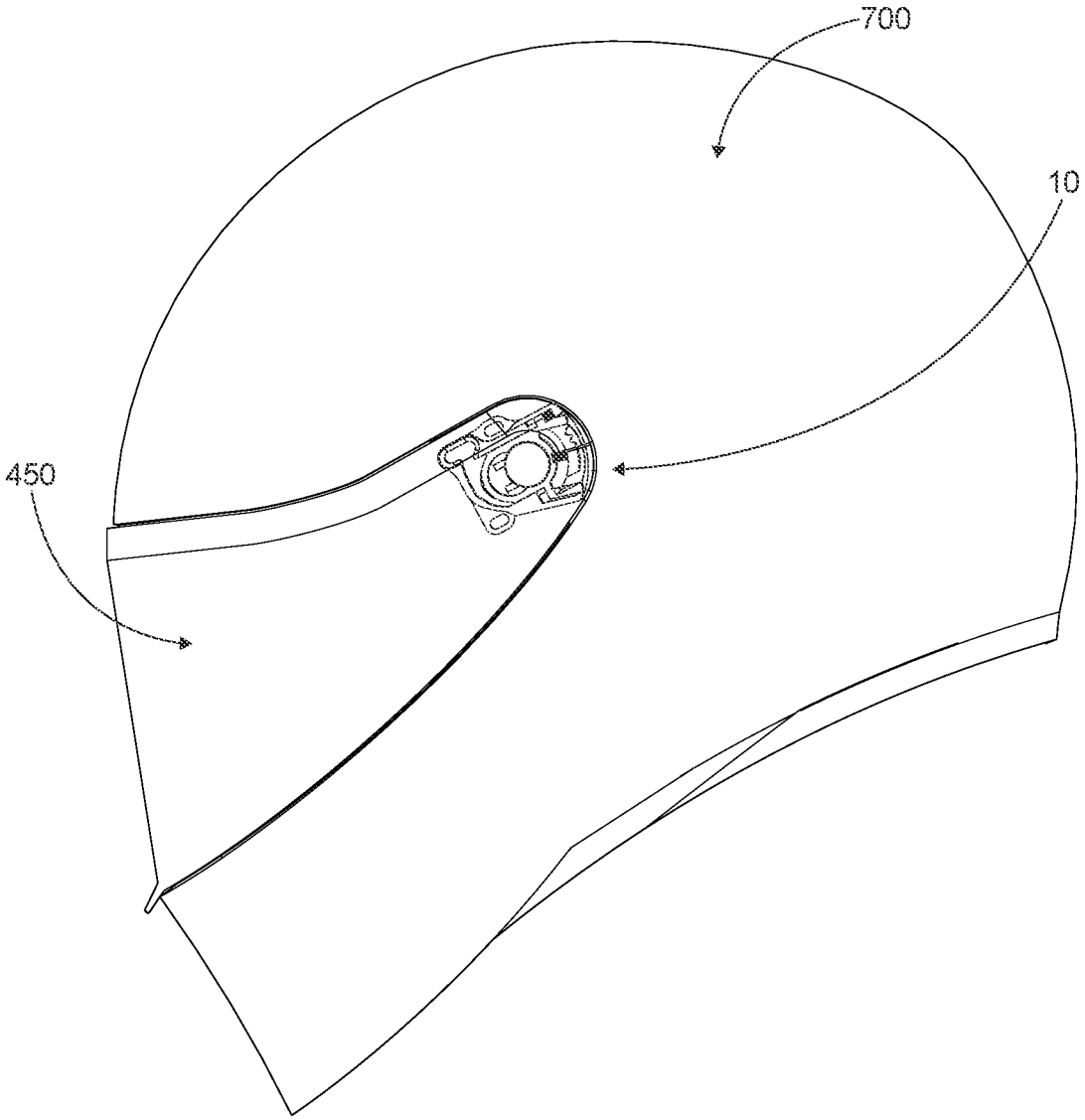

FIGS. 27A and 27B show views of a helmet 700 comprising a pivot mechanism 10 (or 50 not shown) and shield 450 wherein the shield is in raised and lowered configurations. In these views, the shield 450 is shown as transparent to allow the hinge mechanism 10 or 50 to be shown.

As discussed above, a helmet may comprise two pivot mechanisms disclosed herein, one on each side the helmet with a shield therebetween. The second pivot mechanism of the two pivot mechanism may be a mirror image of the first pivot mechanism.

Where the above examples, embodiments and implementations reference examples, it should be understood by those of ordinary skill in the art that other helmet and devices and examples could be intermixed or substituted with those provided as virtually any component consistent with the intended operation of a method, system, or implementation may be utilized. Accordingly, for example, although particular component examples may be disclosed, such components may be comprised of any shape, size, style, type, model, version, class, grade, measurement, concentration, material, weight, quantity, and/or the like consistent with the intended purpose, method and/or system of implementation. In places where the description above refers to particular embodiments of helmets and pivot mechanisms, it should be readily apparent that a number of modifications may be made without departing from the spirit thereof and that these embodiments and implementations may be applied to other to gear and equipment technologies as well. Accordingly, the disclosed subject matter is intended to embrace all such alterations, modifications, and variations that fall within the spirit and scope of the disclosure and the knowledge of one of ordinary skill in the art. The presently disclosed embodiments are, therefore, to be considered in all respects as illustrative and not restrictive.

What is claimed is:

1. A helmet comprising:

an outer shell;

a shield comprising a pivot post, a first detent post forward of the pivot post and a second detent post rearward of the pivot post, wherein the shield is configured to rotate about the pivot post between a raised position and a lowered position; and a hinge mechanism comprising:

(a) a base plate attached to the outer shell of the helmet, the base plate comprising a planar region having a raised portion defining a first curved face proximate a forward end, a raised portion proximate a first side and a raised portion proximate a second side; wherein a portion of the raised portion proximate the first side and a portion of the raised portion proximate the second side are disposed parallel to each other and define slide tracks on the first side and the second side;

(b) a pivot member having a forward end defining a second curved face facing the first curved face, a first side and a second side each having a slide rail configured to slidingly engage slide tracks on the respective first side and second side of the base plate for forward and rearward movement relative to the base plate, the pivot member configured to be engaged to the pivot post of the shield; wherein the pivot member is configured to move forwardly and rearwardly with the pivot post of the shield and wherein the first detent post is slidably receivable between the first curved face and the second curved face, the first side and the second side of the pivot member each having sliding extensions that extend beyond the rearward end defining a space therebetween;

(c) a detent member having a first end, a second end, a forward side, a rearward side comprising a first detent position proximate to the first end and a second detent position proximate to the second end, the second detent post receivable in the first and second detent positions, a first slide extension on the first end configured to slidingly engage the extension of the first side of the rearward end of the pivot member, and a second slide extension on the second end configured to slidingly engage the extension of the second side of the rearward end of the pivot member;

(d) a first resilient member engaged to the base plate and the pivot member, configured to urge the pivot member toward the forward end of the base plate; and (e) a second resilient member engaged to the pivot member and the forward side of the detent member, configured to urge the detent member away from the second end of the pivot member towards the second detent post.

2. The helmet of claim 1 wherein the first resilient member comprises a spring.

3. The helmet of claim 1 wherein the second resilient member comprises a spring.

4. The helmet of claim 1 wherein the rearward side of the detent member is curved.

5. The helmet of claim 4 wherein the detent member further comprises a detent to dispose the shield in an intermediate vented position.

6. The helmet of claim 1, wherein the pivot member has a keyhole opening sized to receive the detent post therethrough in a forward position.

7. The helmet of claim 1 wherein the hinge mechanism is further configured to draw the shield inward toward the helmet when the shield is moved to the lowered position.

8. The helmet of claim 1, wherein the slide tracks of the base plate have a stepped configuration; and wherein the first side and the second side of the pivot member each have a stepped rail configured to engage the slide tracks proximate the respective first and second sides of the base plate.

9. A helmet comprising:

an outer shell;

a shield comprising a pivot post, a first detent post forward of the pivot post and a second detent post rearward of the pivot post, wherein the shield is configured to rotate about the pivot post between a raised position and a lowered position; and a hinge mechanism comprising:

(a) a base plate attached to the outer shell of the helmet, the base plate comprising a planar region having a raised portion defining a first curved face proximate a forward end, a raised portion proximate a first side and a raised portion proximate a second side; wherein a portion of the raised portion proximate the first side and a portion of the raised portion proximate the second side are disposed parallel to each other and define slide tracks on the first side and the second side;

(b) a pivot member having a forward end defining a second curved face facing the first curved face, a first side and a second side each each having a slide rail configured to slidingly engage slide tracks on the respective first side and second side of the base plate for forward and rearward movement relative to the base plate, the pivot member configured to be engaged to the pivot post of the shield; wherein the pivot member is configured to move forwardly and rearwardly with the pivot post of the shield and wherein the first detent post is slidably receivable between the first curved face and the second curved face, the first side and the second side of the pivot member each having sliding extensions that extend beyond the rearward end defining a space therebetween;

(c) a detent member having a first end, a second end, a forward side, a rearward side comprising a first detent position proximate to the first end and a second detent position proximate to the second end, the second detent post receivable in the first and second detent positions, a first slide extension on the first end configured to slidingly engage the extension of the first side of the rearward end of the pivot member, and a second slide extension on the second end configured to slidingly engage the extension of the second side of the rearward end of the pivot member;

(d) a spring engaged to the base plate and the pivot member, configured to urge the pivot member toward the forward end of the base plate; and (e) a spring engaged to the pivot member and the forward side of the detent member, configured to urge the detent member away from the second end of the pivot member towards the second detent post.

10. The helmet of claim 9 wherein the rearward side of the detent member is curved.

11. The helmet of claim 9 wherein the detent member further comprises a detent to dispose the shield in an intermediate vented position.

12. The helmet of claim 9, wherein the pivot member has a keyhole opening sized to receive the detent post therethrough in a forward position.

13. The helmet of claim 9 wherein the hinge mechanism is further configured to draw the shield inward toward the helmet when the shield is moved to the lowered position.

14. The helmet of claim 9, wherein the slide tracks of the base plate have a stepped configuration; and wherein the first side and the second side of the pivot member each have a stepped rail configured to engage the slide tracks proximate the respective first and second sides of the base plate.

15. A helmet comprising:

an outer shell;

a shield comprising a pivot post, a first detent post forward of the pivot post and a second detent post rearward of the pivot post, wherein the shield is configured to rotate about the pivot post between a raised position and a lowered position; and a hinge mechanism comprising (a) a base plate attached to the outer shell of the helmet, the base plate comprising a planar region having a raised portion defining a first curved face proximate a forward end, a raised portion proximate a first side and a raised portion proximate a second side; wherein a portion of the raised portion proximate the first side and a portion of the raised portion proximate the second side are disposed parallel to each other and define tracks having a stepped configuration on the first side and the second side;

(b) a pivot member having a forward end defining a second curved face facing the first curved face, a first side and a second side each having a stepped rail configured to slidingly engage the tracks on the respective first side and second side of the base plate for forward and rearward movement relative to the base plate, the pivot member configured to be engaged to the pivot post of the shield; wherein the pivot member is configured to move forwardly and rearwardly with the pivot post of the shield and wherein the first detent post is slidably receivable between the first curved face and the second curved face, the first side and the second side of the pivot member each having sliding extensions that extend beyond the rearward end defining a space therebetween;

(c) a detent member having a first end, a second end, a forward side, a rearward side comprising a first detent position proximate to the first end and a second detent position proximate to the second end, the second detent post receivable in the first and second detent positions, a first slide extension on the first end configured to slidingly engage the extension of the first side of the rearward end of the pivot member, and a second slide extension on the second end configured to slidingly engage the extension of the second side of the rearward end of the pivot member;

(d) a first resilient member engaged to the base plate and the pivot member, configured to urge the pivot member toward the forward end of the base plate; and (e) a second resilient member engaged to the pivot member and the forward side of the detent member, configured to urge the detent member away from the second end of the pivot member towards the second detent post.

16. The helmet of claim 15 wherein the first resilient member comprises a spring.

17. The helmet of claim 15 wherein the second resilient member comprises a spring.

18. The helmet of claim 15 wherein the rearward side of the detent member is curved.

19. The helmet of claim 18 wherein the detent member further comprises a detent to dispose the shield in an intermediate vented position.

20. The helmet of claim 15, wherein the pivot member has a keyhole opening sized to receive the detent post therethrough in a forward position.

21. The helmet of claim 15 wherein the hinge mechanism is configured to draw the shield inward toward the helmet when the shield is moved to the lowered position.

* * * * *